US006725655B2

(12) United States Patent
Yoshirawa et al.

(10) Patent No.: US 6,725,655 B2
(45) Date of Patent: Apr. 27, 2004

(54) EXHAUST MANIFOLD FOR INTERNAL COMBUSTION ENGINE

(75) Inventors: Koudai Yoshirawa, Yokosuka (JP); Kazuya Hasegawa, Tokyo (JP); Kouji Mori, Yokosuka (JP)

(73) Assignee: Nissan Motor Co., Ltd., Yokohama (JP)

( * ) Notice: Subject to any disclaimer, the term of this patent is extended or adjusted under 35 U.S.C. 154(b) by 3 days.

(21) Appl. No.: 09/994,667

(22) Filed: Nov. 28, 2001

(65) Prior Publication Data

US 2002/0069643 A1 Jun. 13, 2002

(30) Foreign Application Priority Data

Dec. 7, 2000 (JP) ..... 2000-373501
Nov. 13, 2001 (JP) ..... 2001-347990

(51) Int. Cl.[7] ..... F01N 7/10
(52) U.S. Cl. ..... 60/323; 60/324
(58) Field of Search ..... 60/321, 322, 323, 60/313, 324

(56) References Cited

U.S. PATENT DOCUMENTS

| | | | | | |
|---|---|---|---|---|---|
| 2,841,951 | A | * | 7/1958 | Whitcomb | 60/323 |
| 3,468,124 | A | | 9/1969 | Hraboweckyj | |
| 3,507,301 | A | * | 4/1970 | Larson | 137/602 |
| 4,160,364 | A | | 7/1979 | Mori et al. | |
| 4,197,704 | A | * | 4/1980 | Date et al. | 60/322 |
| 4,383,410 | A | * | 5/1983 | Kimura | 60/278 |
| 4,745,742 | A | * | 5/1988 | Nada et al. | 60/276 |
| 5,572,868 | A | * | 11/1996 | Okamoto et al. | 60/323 |
| 5,727,386 | A | * | 3/1998 | Watanabe et al. | 60/323 |
| 5,761,905 | A | * | 6/1998 | Yamada et al. | 60/322 |
| 5,816,044 | A | * | 10/1998 | Biggs | 60/282 |
| 5,816,045 | A | * | 10/1998 | Blocker et al. | 60/323 |
| 5,881,553 | A | * | 3/1999 | Steenackers et al. | 60/323 |
| 6,082,103 | A | * | 7/2000 | Sugiura et al. | 60/323 |
| 6,205,778 | B1 | * | 3/2001 | Akaba et al. | 60/323 |
| 6,263,669 | B1 | * | 7/2001 | Kim | 60/323 |

FOREIGN PATENT DOCUMENTS

| | | | | |
|---|---|---|---|---|
| EP | 0818616 | A1 | | 1/1998 |
| FR | 2179689 | A | | 11/1973 |
| JP | 59-188022 | A | | 10/1984 |
| JP | 61-266150 | A | | 11/1986 |
| JP | 63-179142 | | * | 7/1988 |
| JP | 63-168235 | U | | 11/1988 |
| JP | 63-177613 | U | | 11/1988 |
| JP | 11-13468 | A | | 5/1989 |
| JP | 1-115831 | U | | 9/1989 |
| JP | 3-275934 | A | | 12/1991 |
| JP | 5-6122 | U | | 1/1993 |
| JP | 6-74034 | A | | 3/1994 |
| JP | 6-241040 | A | | 8/1994 |
| JP | 7-63092 | A | | 3/1995 |
| JP | 7-97921 | A | | 4/1995 |

* cited by examiner

*Primary Examiner*—Thomas Denion
*Assistant Examiner*—Diem Tran
(74) *Attorney, Agent, or Firm*—Shinjyu Global IP Counselors, LLP.

(57) ABSTRACT

An exhaust manifold provides improved output by suppressing exhaust interference between cylinders at the exhaust manifold. An air-fuel ratio sensor is installed in position where it can uniformly detect the exhaust gas of each cylinder. The exhaust manifold has a plurality of exhaust tubes, one per cylinder, that connect with a collector case. Each of exhaust tubes has a linear portion located directly above the section where it merges with the collector case. The exhaust tubes are connected to the collector case such that the center axes of the linear portions intersect at intersection point inside the collector case or downstream thereof. The air-fuel ratio sensor is arranged such that its detecting part is positioned in the vicinity of the intersection point. Depending upon whether the exhaust tubes of cylinders have firing orders that are successive or not determines whether the exhaust tubes are slanted or parallel with respect to each other.

29 Claims, 17 Drawing Sheets

EXHAUST MANIFOLD FOR INTERNAL COMBUSTION ENGINE

BACKGROUND OF THE INVENTION

1. Field of the Invention

The present invention generally relates to an exhaust manifold configuration that improves the output performance and exhaust performance of an internal combustion engine.

2. Background Information

Many internal combustion engines have an exhaust manifold with a single exhaust tube extending from each cylinder. The exhaust tubes are typically merged together. This merger of the exhaust tubes can result in exhaust interference and reduced output depending on the exhaust order of the merged cylinders and the position where the exhaust tubes are merged.

Japanese Laid-Open Patent Publication No. 59-188022 discloses an engine exhaust manifold for a four cylinder in line engine. The exhaust manifold disclosed in this publication merges the exhaust tubes of cylinders having non-successive firing order first, i.e., cylinders #1 and #4 and cylinders #2 and #3. However, in recent years, the demand for improved exhaust performance of internal combustion engines has created a need for the catalyst to be held directly below the exhaust manifold. In such an arrangement, the distance from the exhaust ports of the internal combustion engine to the catalyst can be very shorten. Consequently, when it is attempted to merge the exhaust gases from cylinders #1 and #4 together and the exhaust gases from cylinders #2 and #3 together before merging with the collector case, the exhaust tubes must be merged immediately downstream of the exhaust port outlet. This arrangement leads to the problem of reduced output caused by exhaust interference.

Japanese Laid-Open Patent Publication No. 7-63092 discloses an engine exhaust manifold having two manifold catalytic converters. One of the manifold catalytic converters is provided for the exhaust tubes extending from cylinders #1 and #4. The other manifold catalytic converter is provided for the exhaust tubes extending from cylinders #2 and #3. Thus, the exhaust tubes of cylinders #1 and #4 are merged into a separate manifold catalytic converter from the exhaust tubes of cylinders #2 and #3. With this arrangement, there is little exhaust interference and no reduction of output, but there is the problem of increased cost resulting from using two manifold catalytic converters.

It is also necessary to install an air-fuel ratio sensor, typically an oxygen sensor, in the exhaust manifold in order to utilize the catalyst effectively. The air-fuel ratio sensor needs to be installed in a position where it can uniformly detect the exhaust gas from all of the cylinders. However, in the case of a manifold catalytic converter that is disposed directly below the exhaust manifold, it is becoming difficult to install the air-fuel ratio sensor such that it can uniformly detect the exhaust gas from each cylinder.

Japanese Laid-Open Patent Publication No. 6-241040 discloses an engine exhaust manifold with a collector case that is divided into two chambers by a partitioning wall such that at the exhaust gases from cylinders #1 and #4 are merged into one chamber and the exhaust gases from cylinders #2 and #3 are merged into the other of the chambers. The air-fuel ratio sensor is then arranged in an air communication passageway provided through the partitioning wall. The problem with this arrangement is that, under high load conditions in which the exhaust gas flows at a high speed, the mainstream of the exhaust gas passes through the collector case without much flow toward the communication passageway. Thus it is difficult for the air-fuel ratio sensor to uniformly detect the exhaust gas from each cylinder.

Japanese Laid-Open Patent Publication No. 11-13468 discloses an engine exhaust manifold that uses ribs in the exhaust tubes in order to direct exhaust gas toward the air-fuel ratio sensor. The problem with this arrangement is that the output declines because of these ribs in the exhaust tubes.

In view of the above, there exists a need for an improved exhaust manifold configuration that improves the output performance and exhaust performance of an internal combustion engine. This invention addresses this need in the art as well as other needs, which will become apparent to those skilled in the art from this disclosure.

SUMMARY OF THE INVENTION

In view of the aforementioned problems, one purpose of the present invention is to provide an exhaust manifold that can suppress exhaust interference and improve output even in cases where a manifold catalytic converter is used close to the collector case. Another purpose of the present invention is to provide an exhaust manifold in which it is possible to install an air-fuel ratio sensor in a position where it can uniformly detect the exhaust gas from each cylinder so that the catalyst can be utilized effectively and emissions can be reduced.

In order to achieve the aforementioned purposes an exhaust manifold of an internal combustion engine is provided that comprises a collector case and a plurality of exhaust tubes. The collector case has an upstream end and a downstream end. The exhaust tubes have inlet ends that are adapted to be connected to exhaust ports of the internal combustion engine and outlet ends that are connected to the upstream end of the collector case by merging portions. The outlet ends of the exhaust tubes include linear portions disposed contiguously with the merging portions where the exhaust tubes merge with the collector case. The exhaust tubes have first exhaust tubes with the inlet ends of the first exhaust tubes arranged to receive exhaust gas from cylinders whose firing orders are not successive. The linear portions of the first exhaust tubes, whose firing orders are not successive, are slanted with respect to each other such that the linear portions of the first exhaust tubes, whose firing orders are not successive, have center axes intersecting at a point inside the collector case or downstream thereof.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration purposes only and not for the purpose of limiting the invention as defined by the appended claims and their equivalents.

Figure 1:
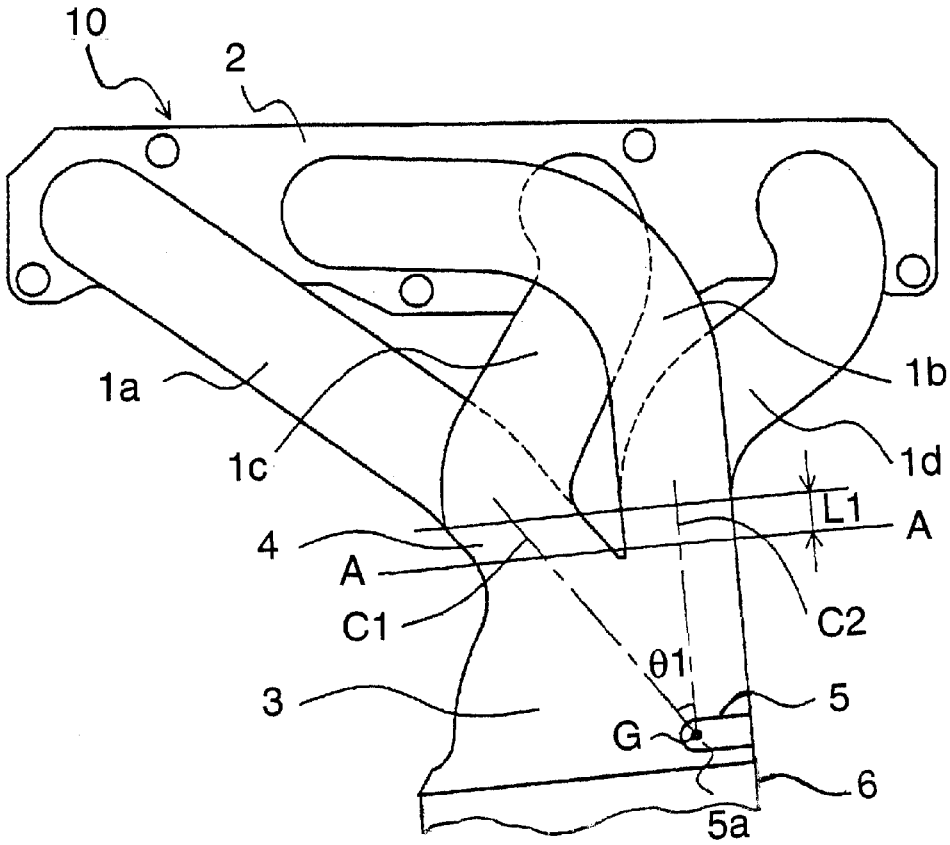
FIG. 1 is a simplified side elevational view of an exhaust manifold in accordance with a first embodiment of the present invention.

Referring initially to FIG. 1, an internal combustion engine exhaust manifold 10 is illustrated to explain a first embodiment of the present invention. The exhaust manifold 10 comprises a plurality of exhaust tubes 1*a* to 1*d*, a mounting flange 2 coupled to the upstream ends of the exhaust tubes 1*a* to 1*d*, and a collector case 3 coupled to the downstream ends of the exhaust tubes 1*a* to 1*d*. Each of the exhaust tubes 1*a* to 1*d* has an upstream end connected to an exhaust port of one of the cylinders of an internal combustion engine via the mounting flange 2 and the downstream end connected to the collector case 3. Preferably, a catalyst unit or catalytic converter 6 is attached to the outlet or downstream end of the collector case 3.

Since catalytic converters are well known in the art, the structure and function of the catalytic converter 6 will not be discussed or illustrated herein. Accordingly, it will further be apparent to those skilled in the art that the catalytic converter 6 can have structure and use any catalyst that will carry out the present invention.

Figure 2:
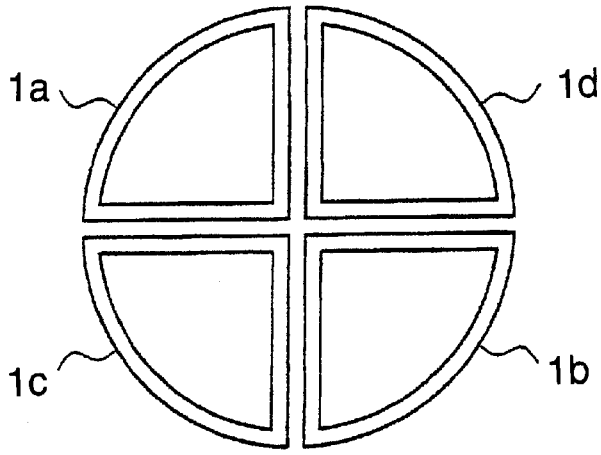
FIG. 2 is a cross sectional view of the exhaust manifold illustrated in FIG. 1 as viewed along line A—A of FIG. 1.
Figure 3:
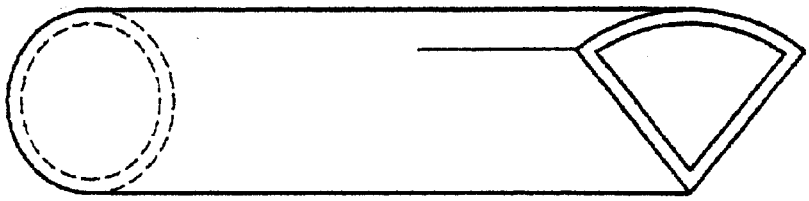
FIG. 3 is an explanatory cross sectional view illustrating the cross sectional shape of one of the exhaust tubes of the exhaust manifold illustrated in FIG. 1.

FIG. 2 shows the cross sectional shape of the portion (section A—A in FIG. 1) where the exhaust tubes 1*a* to 1*d* from the cylinders are merged at the point of connection with the collector case 3. Also, as shown in FIG. 3, the exhaust tubes 1*a* to 1*d* have a substantially circular cross section at one end (i.e., the end that connects to the flange 2) and a substantially fan-shaped cross section at the other end (i.e., the end that connects to the collector case 3). The cross sections of the exhaust tubes 1*a* to 1*d* gradually changes in the section between the two ends. Each of the exhaust tubes 1*a* to 1*d* is substantially fan-shaped and substantially the same size and shape. In other words, the cross sectional shapes of the exhaust tubes 1*a* to 1*d* at the merging portion are substantially fan-shaped and have substantially equal sizes. Therefore, the exhaust tubes 1*a* to 1*d* can be connected to the collector case 3 using sheet metal and welding and the manufacturing cost can be reduced. The exhaust streams from the exhaust tubes 1*a* to 1*d* of the cylinders do not merge with the exhaust tubes of the other cylinders until they merges within the collector case 3. In a four cylinder inline engine, the firing order of the cylinder is as follows: cylinder #1, cylinder #3, cylinder #4 and then cylinder #2. Thus, cylinders #1 and #4 do not have successive firing orders, and cylinders #2 and #3 do not have successive firing orders.

Additionally, each of the exhaust tubes 1*a* to 1*d* has a linear portion 4 that is linearly shaped with a length L1. The linear portions 4 are located directly above the position where the exhaust tubes 1*a* to 1*d* merge with the collector case 3. In other words, the linear portions 4 form the downstream ends of the exhaust tubes 1*a* to 1*d* that are directly or contiguously connected to the collector case 3. The exhaust gas streams of the exhaust tubes 1*a* to 1*d* are directed by the linear portions 4 and flow downstream into the collector case 3. Therefore, there is little back-flow of the exhaust gas streams from one of the exhaust tubes 1*a* to 1*d* of one of the cylinders into one or more of the exhaust tube from the other cylinders. In other words, exhaust interference is reduced while output is improved.

Cylinders #1 and #4 do not have successive firing orders. The linear portions 4 of the exhaust tube 1*a* of cylinder #1 and the exhaust tube 1*d* of cylinder #4 are slanted with respect to each other such that their centerlines or axes C1 and C2 intersect with angle θ1 inside the collector case 3 to form intersection point G.

Cylinders #2 and #3 do not have successive firing orders. The linear portions 4 of the exhaust tube 1*b* of cylinder #2 and the exhaust tube 1*c* of cylinder #3 are also slanted in the same manner as cylinders #1 and #4. In other words, the center axes C1 and C2 of the exhaust tubes 1*b* and 1*c* of cylinder #2 and cylinder #3, respectively, are slanted to form an angle θ1 inside the collector case 3 at the intersection point G. Of course, the intersection point G of the center axes C1 and C2 of the exhaust tubes 1*b* and 1*c* are located directly behind the intersection point G of the center axes C1 and C2 of the exhaust tubes 1*a* and 1*d*.

The centerlines C1, C2, C3 and C4 of the linear portions 4 are lines that are oriented in the flow direction and pass through the center of gravity of the substantially fan-shaped cross section each linear portion 4. The linear portions 4 of the exhaust tube 1*a* of cylinder #1 and the exhaust tube 1*c* of cylinder #3, which cylinders have successive firing orders, are substantially parallel to each other. Similarly, the exhaust tube 1*d* of cylinder #4 and the exhaust tube 1*b* of cylinder #2 have successive firing orders with the linear portions 4 being substantially parallel.

Figure 4:
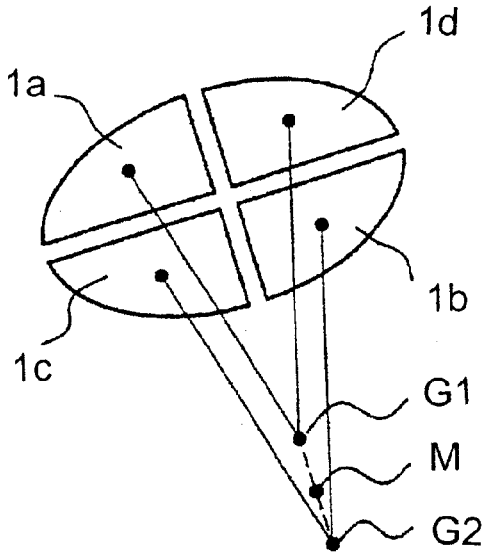
FIG. 4 is a simplified schematic view showing the direction of the center axes of the linear portions of the exhaust tubes of the exhaust manifold in accordance with the first embodiment of the present invention illustrated in FIG. 1.

Thus, in this first embodiment, the centerlines C1, C2, C3 and C4 of the linear portions 4 of the exhaust tubes 1*a* to 1*d* are disposed as shown in FIG. 4 and have two intersection points G (G1, G2).

The collector case 3 is preferably substantially a partial sphere at the connection to the downstream ends of the exhaust tubes 1*a* to 1*d*. Thus, the transverse cross section of the collector case 3 is preferably a substantially circular shape that envelops the exhaust tubes 1*a* to 1*d* of each cylinder. Therefore, the process of connecting the exhaust tubes 1*a* to 1*d*, which are made of pipe, to the collector case 3 can be accomplished using sheet metal and welding steps. This arrangement results in reducing the cost of manufacturing the exhaust manifold 10 in comparison with cast molding the manifold as a single unit.

Since the collector case 3 has a diffuser shape whose cross sectional area is sufficiently large with respect to the exhaust tubes 1*a* to 1*d*, the exhaust gas streams from the exhaust tubes 1*a* to 1*d* spreads inside the collector case 3 but also maintains the directivity as it flows downstream.

Meanwhile, in order to detect the air-fuel ratio of the exhaust gas, an air-fuel ratio sensor 5 is installed so that it faces inside the case from a wall of the collector case 3. The air-fuel ratio sensor 5 is typically an oxygen sensor. The air-fuel ratio sensor 5 is a conventional component that is well known in the art. Since air-fuel ratio sensors are well known in the art, the construction of the air-fuel ratio sensor 5 will not be discussed or illustrated herein. The detecting part 5*a* at the tip of the air-fuel ratio sensor 5 is positioned in the vicinity of the intersection point G. As a result, the air-fuel ratio sensor 5 can detect the concentration of the exhaust gas of each cylinder uniformly. Since there are actually two intersection points G in the four cylinder inline engine, the detecting part 5*a* at the tip of the air-fuel ratio sensor 5 should be positioned at an intermediate position between the two intersection points G. In particular, the detecting part 5*a* should be positioned close to the midpoint M of the line segment that joins the two intersection points G1 and G2 as shown in FIG. 4. In other words, the detecting part 5*a* of an air-fuel ratio sensor is positioned close to the intersection points G so that the air-fuel ratio sensor 5 can uniformly detect the concentration of the exhaust gas streams of each cylinder. As a result, the catalyst unit 6 can be used effectively and emissions can be reduced because the air-fuel ratio can be controlled with good precision.

Thus, in this first embodiment of the present invention, the linear portions 4 of the exhaust tubes 1*a* to 1*d* are connected separately to the collector case 3 so that the exhaust gas streams of each cylinder does not interfere with the exhaust gas streams of the other cylinders until it enters the collector case 3. Also, since the exhaust gas streams of each cylinder flows directly into the collector case 3, the amount of back-flow into the exhaust tubes 1*a* to 1*d* of the other cylinders caused by exhaust pulsation is small. As a result, exhaust gas interference can be reduced and output can be improved.

Additionally, since the center axes C1 and C2 of the linear portions 4 of at least the exhaust tubes 1*a* to 1*d* connected to cylinders of non-successive firing order are slanted with respect to each other and intersect downstream, the exhaust gas streams from the cylinders can be mixed to some degree inside the collector case 3 before being directed to the catalytic converter 6, while, at the same time, exhaust gas interference between cylinders of successive firing order can be prevented. Furthermore, this arrangement makes it easy to position an air-fuel ratio sensor 5 such that it can detect the concentration of the exhaust gas from each cylinder uniformly. When the linear portions 4 of the exhaust tubes 1*a* to 1*d* connected to cylinders with successive firing orders are substantially parallel to each other, exhaust interference between these exhaust tubes can be reduced with certainty.

Now, the advantages and disadvantages of the first embodiment (i.e., where the exhaust tubes of the cylinders of non-successive firing order have intersection point GI or G2, while those of cylinders of successive firing order are parallel) will be discussed with reference to FIGS. 5–7. Specifically, the advantages and disadvantages of the first embodiment will be discussed from the standpoint of: (1) the effect of reducing exhaust gas interference; (2) the effect of making the flow rate distribution inside the catalyst more uniform; and (3) the effect of improving the sensitivity of the air-fuel ratio sensor.

The exhaust gas interference is reduced in the first embodiment since two pairs of cylinders are parallel. Also, since exhaust gas interference occurs more readily between the cylinders whose firing orders are successive, the exhaust gas interference can be reduced further in the first embodiment because the two pairs of cylinders whose firing orders are successive are arranged so as to be parallel.

Figure 5:
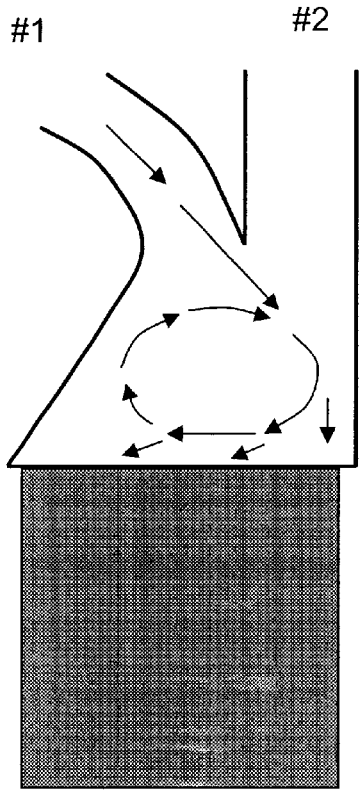
FIG. 5 is a first explanatory cross sectional view illustrating the flow of exhaust gas from the first exhaust tube into the collector case of the exhaust manifold illustrated in FIG. 1 as viewed along line B—B of FIG. 7.
Figure 6:
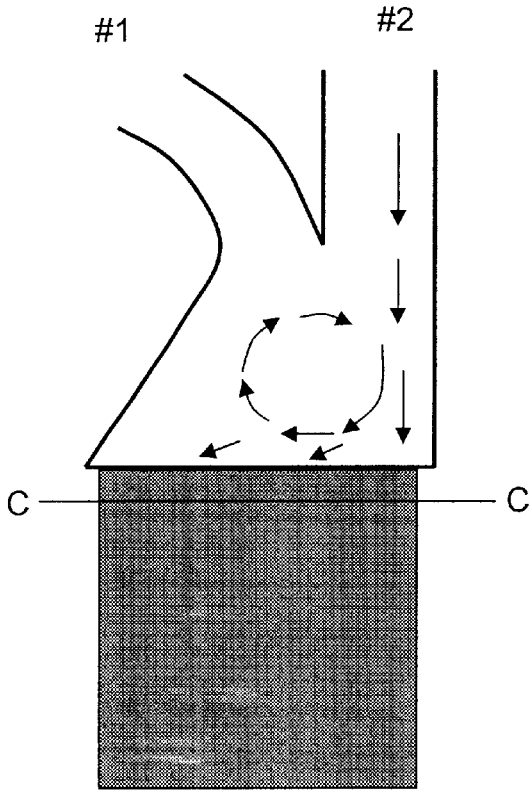
FIG. 6 is a second explanatory cross sectional view illustrating the flow of exhaust gas from the second exhaust tube into the collector case of the exhaust manifold illustrated in FIG. 1 as viewed along line B—B of FIG. 7.
Figure 7:
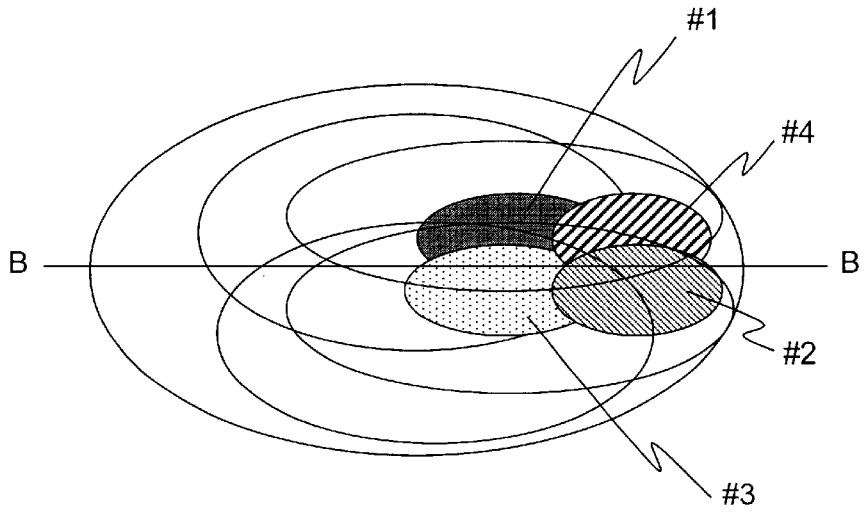
FIG. 7 is a explanatory cross sectional view illustrating the flow of exhaust gas from the four exhaust tubes into the catalytic converter of the exhaust manifold illustrated in FIG. 1 as viewed along line C—C of FIG. 5.

The intra-catalyst flow rate distribution unifying effect will discussed using FIGS. 5–7. The flow patterns of the exhaust gas from the linear portions 4 of the exhaust tubes 1*a* to 1*d* into the collector case 3 is shown in FIGS. 5 and 6. FIG. 7 illustrates the main flow area (shown by the shaded ovals) and the entire flow area (shown by the larger ovals)

of the exhaust gas from each cylinder in a front-end plane of the catalytic converter 6 corresponding to section C—C in FIG. 5. The exhaust gas that flows into the collector case 3 (the catalyst diffuser section) from the exhaust tubes 1*a* to 1*d* diffuses inside the collector case 3 as it flows into the catalytic converter 6 (the catalyst carrier section). When two cylinders are parallel as in the first embodiment, the concentration of the main flow of gas into the catalytic converter 6 can be reduced. When the flow of exhaust gas is concentrated, the performance of the catalytic converter 6 deteriorates more rapidly in that area and the durability performance of the catalytic converter 6 declines.

The exhaust gas that enters the collector case 3 (catalyst diffuser section) from the exhaust tubes 1*a* to 1*d* forms a large vortex (vertical vortex) in the collector case 3 as it flows into the catalytic converter 6 (the catalyst carrier section). Thus, the exhaust gas flows gradually into the catalytic converter 6 (the catalyst carrier section), while forming a vortex as seen in FIGS. 5 and 6. In this arrangement, the diameter of the vortex is largest and the vortex is the most stable when the vortex forms so as to be parallel with plane B—B shown in FIG. 7.

When four cylinders are concentrated on a single point as shown in the in the third embodiment (FIGS. 10 and 11), it is difficult to form a large vortex because the gas flows in at an angle with respect to the plane B—B of FIG. 7. Furthermore, the exhaust gas from each cylinder interferes with the vortexes formed by exhaust gases from all the other cylinders. Conversely, when two cylinders are arranged to have parallel flow as in the first embodiment, a vortex forms more readily because the exhaust gas flows in such that it is parallel to the plane B—B. Furthermore, a stable vortex is formed because the vortexes of the two parallel cylinders do not interfere with each other. Consequently, the flow distribution of not only the exhaust gas in the main flow area but also of the exhaust gas that diffused as it formed a vortex spreads more widely as the exhaust gas passes through the catalytic converter 6 and the flow of gas inside the catalytic converter 6 becomes more uniform (see FIG. 7).

In the first embodiment, in which cylinders whose firing orders are successive are arranged in pairs having parallel flow, there is little interference between the respective vortexes formed by the exhaust gases from the two cylinders making up each pair (because the vortexes form so as to be parallel to the plane B—B). Consequently, it is easier for the vortexes to form than in the second embodiment (FIG. 8) discussed below, in which cylinders whose firing orders are not successive are arranged in pairs having parallel flow. As a result, as discussed previously, the exhaust gases diffuse as they form vortexes and consequently the flow distribution spreads more widely as the exhaust gases pass through the catalytic converter 6 and the flow of the exhaust gases inside the catalytic converter 6 becomes more uniform.

The air-fuel ratio sensor sensitivity improvement effect will now be discussed. The sensitivity of the air-fuel ratio sensor 5 can be improved the most by concentrating all four cylinders on a single point, and positioning the air-fuel ratio sensor 5 at that point. Since the exhaust gases from the linear portions 4 of the exhaust tubes 1*a* to 1*d* converge at the air-fuel ratio sensor 5, the air-fuel ratio sensor sensitivity is improved.

Second Embodiment

Figure 8:
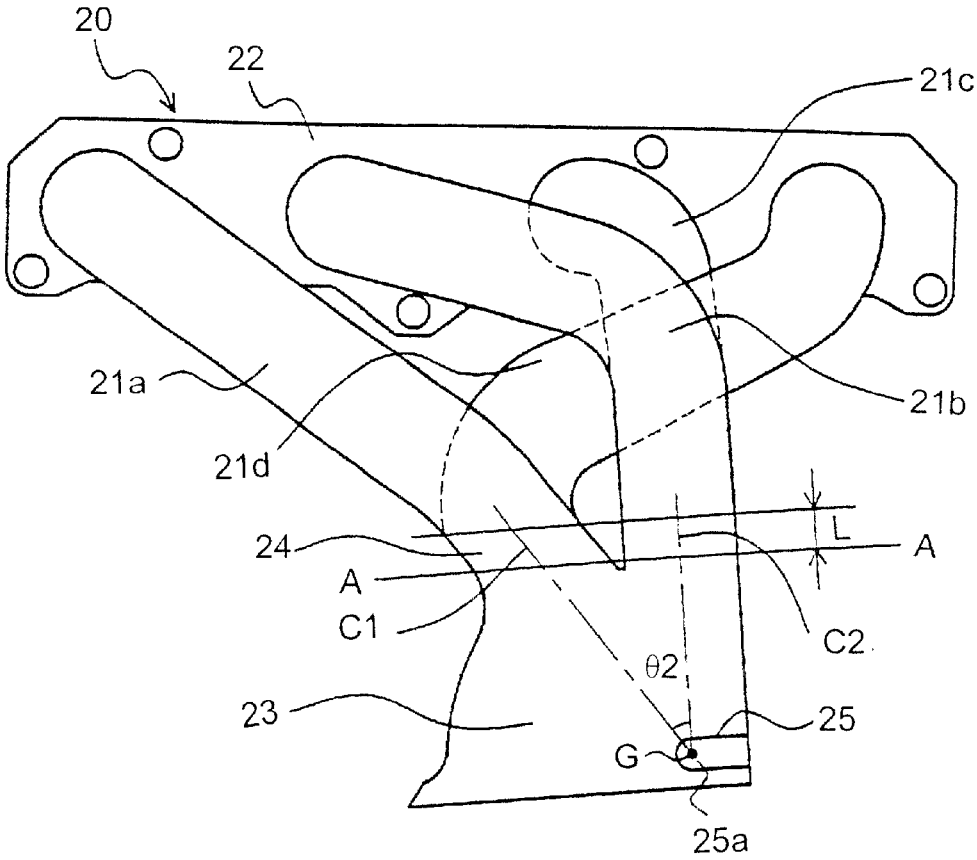
FIG. 8 is a simplified side elevational view of an exhaust manifold in accordance with a second embodiment of the present invention.
Figure 9:
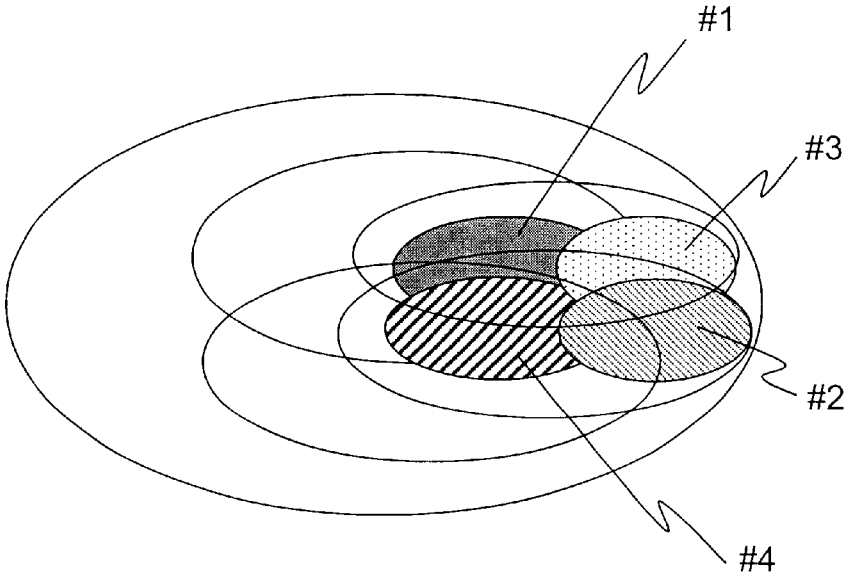
FIG. 9 is a explanatory cross sectional view, similar to FIG. 7, illustrating the flow of exhaust gas from the four exhaust tubes into the catalytic converter of the exhaust manifold of the second embodiment of the present invention illustrated in FIG. 8.

Referring now to FIGS. 8 and 9, an internal combustion engine exhaust manifold 20 is illustrated in accordance with a second embodiment of the present invention. Basically, the first and second embodiments are identical, except that the arrangement of the exhaust tubes 1*a* to 1*c* has been modified in this second embodiment as explained below. In view of the similarity between the first and second embodiments, the parts of the second embodiment that are identical to the parts of the first embodiment will be given the same reference numerals increased by twenty as the parts of the first embodiment. Moreover, the descriptions of the parts of the second embodiment that are identical to the parts of the first embodiment may be omitted for the sake of brevity.

The second embodiment differs from the first embodiment in that the respective linear portions 4 of the exhaust tube 1*a* of the cylinder #1 and the exhaust tube 1*d* of the cylinder #4 are located lateral adjacent one another, and the respective linear portions 4 of the exhaust tube 1*b* of the cylinder #2 and the exhaust tube 1*c* of the cylinder #3 are located lateral adjacent one another. Thus, the respective linear portions 4 of the exhaust tube 1*a* of the cylinder #1 and the exhaust tube 1*b* of the cylinder #2 (which cylinders have successive firing orders) are slanted with respect to each other such that the centerlines C1 and C2 thereof intersect at an angle θ2 inside the collector case 3 and form the intersection point G. Also, the respective linear portions 4 of the exhaust tube 1*c* of the cylinder #3 and the exhaust tube 1*d* of the cylinder #4 (which cylinders have successive firing orders) are also slanted in the same manner.

Meanwhile, the respective linear portions 4 of the exhaust tubes of cylinders whose firing orders are not successive, i.e., the respective linear portions 4 of the exhaust tube 1*a* of cylinder #1 and the exhaust tube 1*d* of cylinder #4 and the respective linear portions 4 of exhaust tube 1*b* of cylinder 2 and exhaust tube 1*c* of cylinder 3, are substantially parallel to each other.

Thus, a certain degree of effect can be obtained by arranging the exhaust tubes of cylinders whose firing orders are successive so as to be slanted with respect to each other and arranging the exhaust tubes of cylinders whose firing orders are not successive so as to be parallel to each other. The effect of reducing exhaust gas interference declines somewhat in comparison with the first embodiment because intersection points have been established for the exhaust tubes of cylinders whose firing orders are successive, between which exhaust gas interference occurs more readily.

In the present invention, the exhaust tubes each have a linear portion 24 that are connected separately to the collector case 23. Consequently, the exhaust gas of each cylinder does not interfere with the exhaust gas of the other cylinders until it enters the collector case 23 and, since the exhaust gas of each cylinder flows into the collector case 23 with directivity, the amount of back-flow into the exhaust tubes of the other cylinders caused by exhaust pulsation is small. As a result, exhaust gas interference can be reduced and output can be improved.

Additionally, since the centerlines C1 and C2 of the linear portions 24 of the a portion of the exhaust tubes, i.e., those connected to cylinders of successive firing order, are slanted with respect to each other and intersect downstream, the exhaust gas from the cylinders can be mixed to some degree inside the collector case 23 before being directed to the catalytic converter. Furthermore, this arrangement makes it easy to position an air-fuel ratio sensor 25 such that it can detect the concentration of the exhaust gas from each cylinder uniformly.

In the embodiment, the linear portions 24 of a portion of the exhaust tubes, i.e., those connected to cylinders whose firing orders are not successive, are generally parallel to each other. Therefore, exhaust interference between these exhaust tubes can be reduced as discussed below.

Now, the advantages and disadvantages of the second embodiment (i.e., where exhaust tubes of cylinders of successive firing order have an intersection point G, while those of cylinders of non-successive firing order are parallel) will be discussed with reference to FIGS. 5, 6 and 9.

The exhaust gas interference is reduced in the second embodiment since two pairs of cylinders are parallel in a similar manner to the first embodiment. The intra-catalyst flow rate distribution unifying effect will discussed using FIGS. 5, 6 and 9. The flow patterns of the exhaust gas from the linear portions 24 of the exhaust tubes 21*a* to 21*d* into the collector case 23 is the same as the first embodiment shown in FIGS. 5 and 6. FIG. 9 illustrates the main flow area (shown by the shaded ovals) and the entire flow area (shown by the larger ovals) of the exhaust gas from exhaust tubes 21*a* to 21*d* in a front-end plane of the catalytic converter that corresponds to section C—C in FIG. 5. The exhaust gas that flows into the collector case 23 (the catalyst diffuser section) from the exhaust tubes 21*a* to 21*d* diffuses inside the collector case 3 as it flows into the catalytic converter (the catalyst carrier section). When two cylinders are parallel as in the second embodiment, the concentration of the main flow of gas into the catalytic converter can be reduced. When the flow of exhaust gas is concentrated, the performance of the catalytic converter deteriorates more rapidly in that area and the durability performance of the catalytic converter declines.

The exhaust gas that enters the collector case 23 (catalyst diffuser section) from the exhaust tubes 21*a* to 21*d* forms a large vortex (vertical vortex) in the collector case 23 as it flows into the catalytic converter (the catalyst carrier section). Thus, the exhaust gas flows gradually into the catalytic converter (the catalyst carrier section), while forming a vortex as seen in FIGS. 5 and 6. In this arrangement, the diameter of the vortex is smaller than the first embodiment.

As mentioned above, when four cylinders are concentrated on a single point as shown in the in the third embodiment (FIGS. 10 and 11), it is difficult to form a large vortex because the gas flows in at an angle with respect to the plane B—B of FIG. 7. Furthermore, the exhaust gas from each cylinder interferes with the vortexes formed by exhaust gases from all the other cylinders. Conversely, when two cylinders are arranged to have parallel flow as in the second embodiment, a vortex forms more readily because the exhaust gas flows in such that it is parallel to the plane B—B. Furthermore, a stable vortex is formed because the vortexes of the two parallel cylinders do not interfere with each other. Consequently, the flow distribution of not only the exhaust gas in the main flow area but also of the exhaust gas that diffused as it formed a vortex spreads more widely as the exhaust gas passes through the catalytic converter and the flow of gas inside the catalytic converter becomes more uniform (see FIG. 9).

In the second embodiment, in which cylinders whose firing orders are not successive are arranged in pairs having parallel flow, there is more interference between the respective vortexes formed by the exhaust gases from the two cylinders making up each pair than in the first embodiment. Consequently, it is harder for the vortexes to form in the second embodiment (FIG. 8) than in the first embodiment, in which cylinders whose firing orders are successive are arranged in pairs having parallel flow.

The air-fuel ratio sensor sensitivity improvement effect will now be discussed. The sensitivity of the air-fuel ratio sensor 25 can be improved the most by concentrating all four cylinders on a single point, as in the third embodiment, and positioning the air-fuel ratio sensor at that point. In this second embodiment, the exhaust gases from the cylinders are more concentrated at the air-fuel ratio sensor 25, than the first embodiment as seen by comparing FIGS. 7 and 9. Thus, the sensitivity of the air-fuel ratio sensor 25 is improved in the second embodiment over the first embodiment.

Third Embodiment

Figure 10:
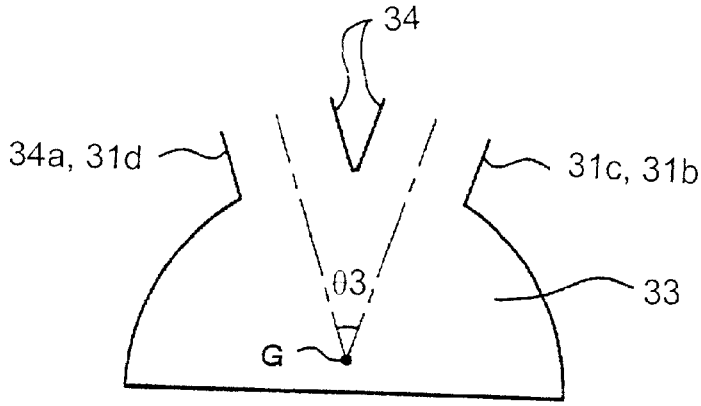
FIG. 10 is a simplified lateral cross sectional view of a modified exhaust manifold in accordance with a third embodiment of the present invention in which the exhaust tubes of the cylinders are all angled.
Figure 11:
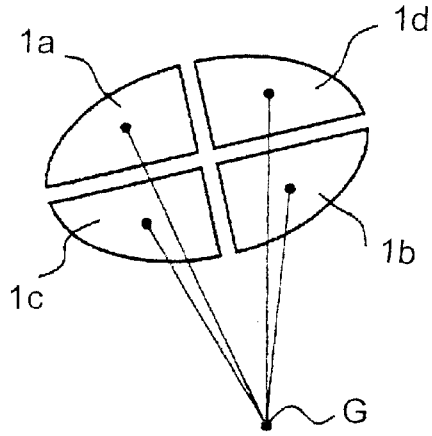
FIG. 11 is a simplified schematic view showing the direction of the center axes of the linear portions of the exhaust tubes of the exhaust manifold illustrated in FIG. 10 in accordance with the third embodiment of the present invention.
Figure 12:
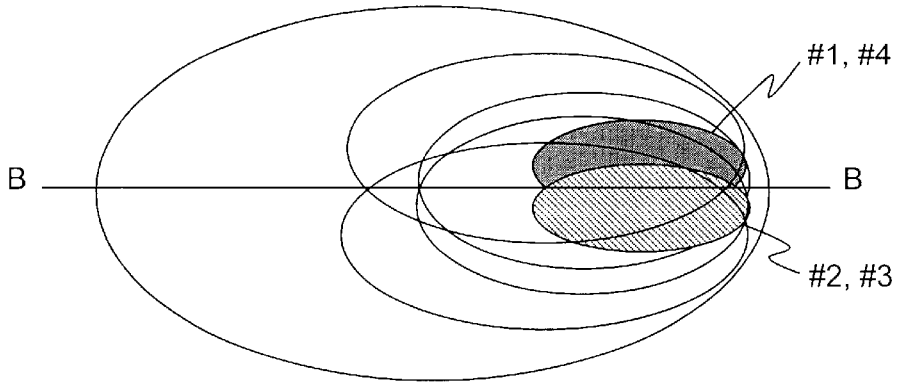
FIG. 12 is a explanatory cross sectional view, similar to FIGS. 7 and 9, illustrating the flow of exhaust gas from the four exhaust tubes into the catalytic converter of the exhaust manifold of the third embodiment of the present invention illustrated in FIGS. 10 and 11.

Referring now to FIGS. 10–12, an internal combustion engine exhaust manifold 30 is illustrated in accordance with a third embodiment of the present invention. Basically, the first and third embodiments are identical, except that angles of the exhaust tube 31*a* to 31*d* have been changed as explained below. In view of the similarity between the first and third embodiments, the parts of the third embodiment that are identical to the parts of the first embodiment will be given the same reference numerals increased by thirty as the parts of the first embodiment. Moreover, the descriptions of the parts of the third embodiment that are identical to the parts of the first embodiment have been omitted for the sake of brevity.

In the first embodiment, exhaust interference is reduced because the exhaust tube 1*a* of the cylinder #1 and the exhaust tube 1*c* of the cylinder #3, which cylinders have successive firing orders, are substantially parallel to each other, and the exhaust tube 1*d* of the cylinder #4 and the exhaust tube 1*b* of the cylinder #2, which cylinders have successive firing orders, are substantially parallel to each other. In the third embodiment, however, the linear portions of the pair of exhaust tubes 31*a* and 31*c* and the pair of exhaust tubes 31*b* and 31*d* are slanted with respect to each other as shown in FIGS. 10 and 11. Thus, the centerlines of these linear portions of the pairs of exhaust tubes 31*a*, 31*c* and 31*b*, 31*d* intersect with angle θ3 inside the collector case 33 (or downstream thereof with a short collector case) so as to form the intersection point G, as shown in FIGS. 10 and 11 (which are, respectively, a view from the left side of and an oblique view of FIG. 1). In other words, the pairs of cylinders have successive firing orders are slanted with respect to each other instead of being parallel to each other as in the prior embodiments. As a result, the linear portions of all exhaust tubes 31*a* to 31*d* are slanted such that their centerlines intersect at an intersection point G located downstream. Stated differently, the center axes of the linear portions 34 of all exhaust tubes 31*a* to 31*d*, including those connected to cylinders whose firing orders are successive, are slanted with respect to each other and intersect downstream. Preferably, the center axes of the exhaust tubes 31*a* to 31*d* intersect at a single intersection point G in this embodiment.

When this arrangement is used, there is a slight drop in output caused by exhaust gas interference, but the air-fuel ratio sensor 35 can detect the concentration of the exhaust gas of each cylinder more uniformly because the detecting part 35*a* of the air-fuel ratio sensor 35 can be positioned at one intersection point G. As a result, there is a higher probability that interference will occur than in the prior embodiment of the invention. However, it is easier to arrange an air-fuel ratio sensor 35 such that it can detect the concentration of the exhaust gas streams of each cylinder uniformly because the exhaust gas streams from all cylinders can be made to merge at a single intersection point G. The sensitivity of the air-fuel ratio sensor 35 can be improved the most by concentrating all four cylinders on a single point G, as in this third embodiment, and positioning the air-fuel ratio sensor at that point.

The intra-catalyst flow rate distribution unifying effect will discussed using FIGS. 5, 6 and 12. The flow patterns of the exhaust gas from the linear portions 34 of the exhaust tubes 31*a* to 31*d* into the collector case 3 is similar to the first embodiment as shown in FIGS. 5 and 6. FIG. 12 illustrates the main flow area (shown by the shaded ovals) and the entire flow area (shown by the larger ovals) of the exhaust gas from each cylinder in a front-end plane of the catalytic converter that corresponds to section C—C in FIG. 5. The exhaust gas that flows into the collector case 33 (the catalyst diffuser section) from the exhaust tubes 31*a* to 31*d* diffuses inside the collector case 33 as it flows into the catalytic converter (the catalyst carrier section). When two cylinders are all slanted as in the third embodiment, the main flow of exhaust gas is concentrated. Thus, the performance of the catalytic converter deteriorates more rapidly in that area and the durability performance of the catalytic converter declines as compared to the first embodiment. In other words, when all four cylinders are concentrated on a single point as in the third embodiment, the main flow areas of the exhaust gas from the cylinders are concentrated in a single region (see FIG. 12).

The exhaust gas that enters the collector case 33 (catalyst diffuser section) from the exhaust tubes 31*a* to 31*d* forms a smaller vortex (vertical vortex) in the merging portion as it flows into the catalytic converter. The gas flows gradually into the catalyst section while forming a vortex (see FIG. 12). In this arrangement, the diameter of the vortex is the smallest and the vortex is the least stable.

When four cylinders are concentrated on a single point as in the third embodiment, it is difficult to form a large vortex because the gas flows in at an angle with respect to plane B—B of FIG. 12. Furthermore, the exhaust gas from each cylinder interferes with the vortexes formed by exhaust gases from all the other cylinders. Conversely, when two cylinders are arranged to have parallel flow as in the first and second embodiments, a vortex forms more readily because the gas flows in such that it is parallel to plane B—B. Furthermore, a stable vortex is formed because the vortexes of the two parallel cylinders do not interfere with each other. Consequently, the flow distribution of not only the gas in the main flow area but also of the gas that diffused as it formed a vortex spreads more widely as the gas passes through the catalyst and the flow of gas inside the catalyst becomes more uniform (see FIG. 12).

Fourth Embodiment

Figure 13:
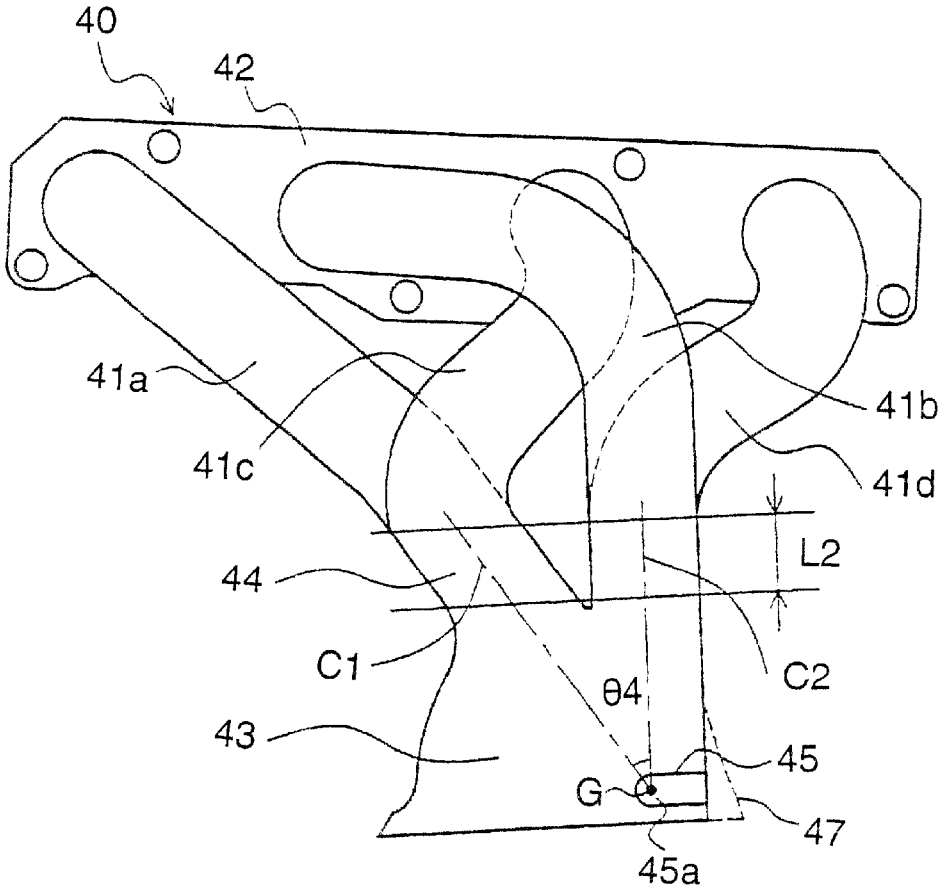
FIG. 13 is a simplified side elevational view of a modified exhaust manifold in accordance with a fourth embodiment of the present invention.

Referring now to FIG. 13, an internal combustion engine exhaust manifold 40 is illustrated in accordance with a second embodiment of the present invention. Basically, the first and fourth embodiments are identical, except that the intersection point G as explained below. In view of the similarity between the first and fourth embodiments, the parts of the fourth embodiment that are identical to the parts of the first embodiment will be given the same reference numerals increased by forty as the parts of the first embodiment. Moreover, the descriptions of the parts of the fourth embodiment that are identical to the parts of the first embodiment have been omitted for the sake of brevity.

The fourth embodiment is similar to the first embodiment (FIG. 1) in that the linear portions 44 of the exhaust tube 41*a* of cylinder #1 and the exhaust tube 41*d* of cylinder #4 are slanted with respect to each other such that their center axes C1 and C2 intersect with angle θ4 inside the collector case 33 to form intersection point G. The linear portions 44 of the exhaust tube 41*b* of cylinder #2 and the exhaust tube 41*c* of cylinder #3 are also slanted in the same manner as cylinders #1 and #4. The fourth embodiment is different from the first embodiment (FIG. 1) in that the lengths L2 of the linear portions 44, which are located directly above the portion where the exhaust tubes 41*a* to 41*d* merge with the collector case 43, are longer. By making the linear portions 44 longer, the flow of exhaust gases that are directed by the linear portions 44 becomes stronger and the amount of exhaust gas that flows backward into the exhaust tubes of the other cylinders is reduced even further. As a result, exhaust interference is reduced and output is improved.

However, when the linear portions 44 are made longer, the distance from the exhaust port to the collector case 43 becomes longer. As a result, the distance to the catalytic converter installed downstream of the collector case 43 becomes longer and the temperature rise characteristic of the catalyst worsens. Consequently, the lengths L2 of the linear portions 44 are determined by the balancing the desired output against the desired emissions, which are determined by the temperature rise characteristic of the catalyst.

As indicated by broken line 47, it is also acceptable to expand the form of the portion where the exhaust gas flows into the catalyst so that the exhaust gas is directed downstream in a more uniform manner. This feature can be applied to the other embodiments of the present invention shown and described herein.

Fifth Embodiment

Figure 14:
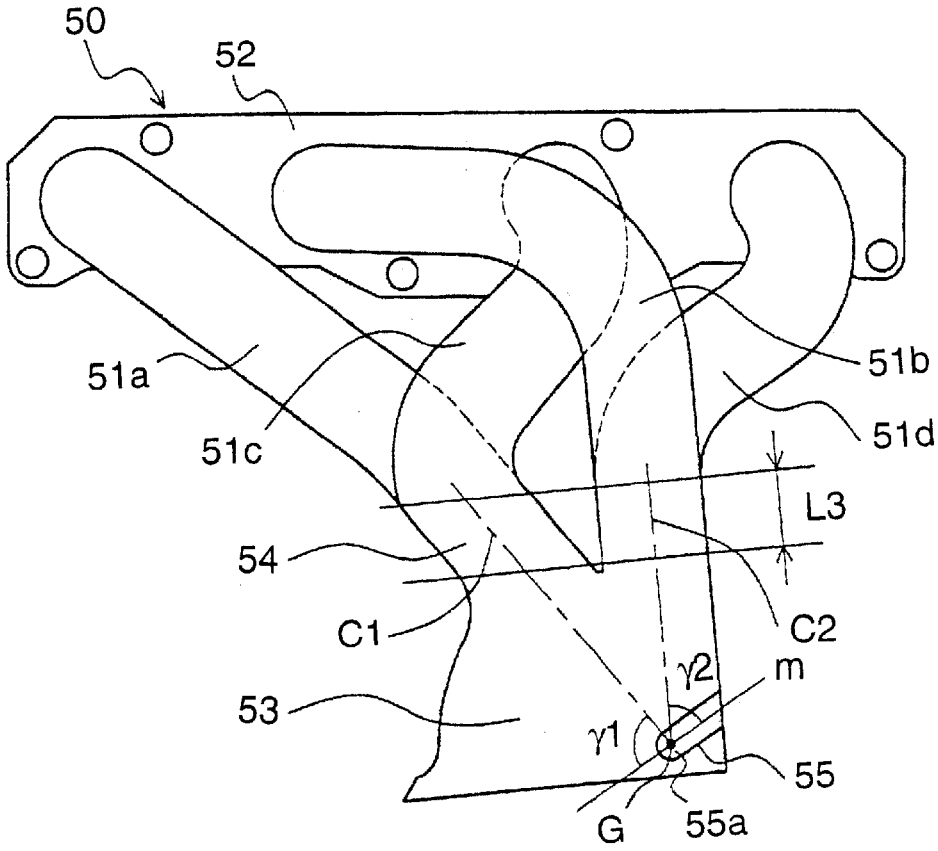
FIG. 14 is a simplified side elevational view of a modified exhaust manifold in accordance with a fifth embodiment of the present invention.

Referring now to FIG. 14, an internal combustion engine exhaust manifold 50 is illustrated in accordance with a fifth embodiment of the present invention. Basically, the fourth and fifth embodiments are identical, except that orientation of the air-fuel ratio sensor 55 has been changed as explained below. In view of the similarity between the fifth embodiment and the prior embodiments, the parts of the fifth embodiment that are identical to the parts of the first embodiment will be given the same reference numerals increased by fifty as the parts of the first embodiment. Moreover, the descriptions of the parts of the fifth embodiment that are identical to the parts of the prior embodiments have been omitted for the sake of brevity.

The fifth embodiment differs from the fourth embodiment (FIG. 13) in that the angle of the air-fuel ratio sensor 55 has been changed relative to the center axes C1 and C2 of the exhaust tube linear portions 54. The detecting part 55*a* of the air-fuel ratio sensor 55 is positioned at intersection point G of the center axes C1 and C2 of the exhaust tube linear portions 54. Also the air-fuel ratio sensor 55 is arranged such that the center axes C1 of the linear portions 54 of the exhaust tubes 51*a* and 51*c* form an angle with the center axis m of the air-fuel ratio sensor 55 that is different from the angle form between the center axes C2 of the linear portions 54 of the exhaust tubes 51*d* and 51*b* and the center axis m.

More specifically, the center axes C1 of the linear portions 54 of the exhaust tubes 51*a* and 51*c* (which are farther from the air-fuel ratio sensor 5) are closer to being perpendicular to the center axis m of the air-fuel ratio sensor 55 that are the center axes C2 of the linear portions 54 of the exhaust tubes 51*d* and 51*b* (which are closer to the air-fuel ratio sensor 55). In other words, the center axes C2 of the linear portions 54 of the exhaust tubes 51*d* and 51*b* (which are closer to the air-fuel ratio sensor 55) are angled so that they are closer to being parallel to the center axis m of the air-fuel ratio sensor 55.

With the angle shown in FIG. 6, the angle γ2 between the center axes C2 of the linear portions 54 of the exhaust tubes

51*d* and 51*b* (which are closer to the air-fuel ratio sensor 55) and the center axis m of the air-fuel ratio sensor 55 is more acute than the angle γ1 between the center axes C1 of the linear portions 54 of the exhaust tubes 51*a* and 51*c* (which are farther from the air-fuel ratio sensor 55) and the center axis m of the air-fuel ratio sensor 55. That is, γ2<γ1.

If angle γ2 equals angle γ1, then the exhaust gas streams from the exhaust tubes 51*d* and 51*b*, which are closer to the air-fuel ratio sensor 55, will strike air-fuel ratio sensor 55 more strongly. This will cause thermal degradation of the air-fuel sensor 55. Making angle γ2 less than angle γ1 suppresses excessive striking of exhaust gas streams from the exhaust tubes 51*d* and 51*b* against the oxygen sensor 55.

Thus, in this embodiment, the center axes of the linear portions 54 are angled such that the center axis C1 of the linear portion 54 that is farther from the air-fuel ratio sensor 55 is closer to being perpendicular to the center axis m of the air-fuel ratio sensor 55 than is the center axis C2 of the linear portion 54 that is closer to the air-fuel ratio sensor 55. In other words, the center axis C1 of the linear portion 54 that is closer to the air-fuel ratio sensor 55 is angled so that it is closer to being parallel to the center axis m of the air-fuel ratio sensor 55. Therefore, exhaust gas stream from the cylinder that is closer to the air-fuel ratio sensor 55 can be prevented from striking the air-fuel ratio sensor 55 too strongly when the load is high and thermal degradation of the air-fuel ratio sensor 55 can be prevented. As a result, the air-fuel ratio can be controlled more precisely and emissions can be reduced because degradation of the air-fuel ratio sensor 55 over time can be reduced.

Sixth Embodiment

Figure 15:
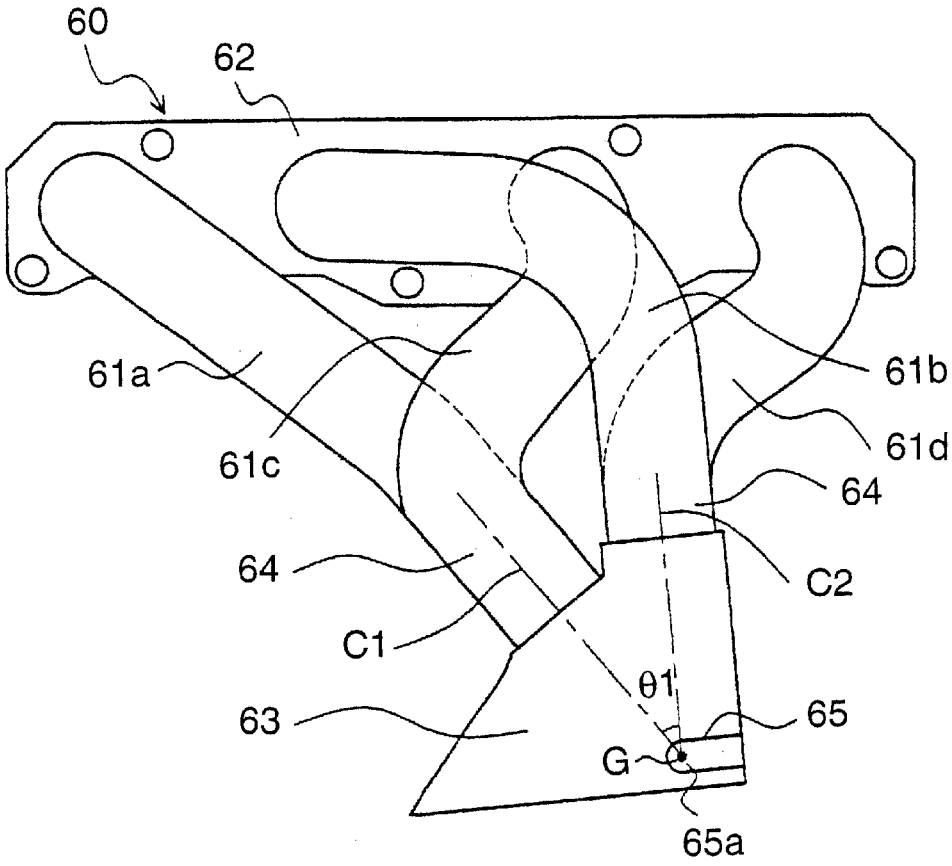
FIG. 15 is a simplified side elevational view of a modified exhaust manifold in accordance with a sixth embodiment of the present invention.

Referring now to FIG. 15, an internal combustion engine exhaust manifold 60 is illustrated in accordance with a sixth embodiment of the present invention. Basically, the sixth embodiment differs from the fourth embodiment (FIG. 13) in that the positions where the linear portions 64 of the exhaust tubes 61*a* to 61*d* merge with the collector case 63 are different as explained below. In view of the similarity between the sixth embodiment and the prior embodiments, the parts of the sixth embodiment that are identical to the parts of the prior embodiments will be given the same reference numerals increased by sixty as the parts of the first embodiment. Moreover, the descriptions of the parts of the sixth embodiment that are identical to the parts of the prior embodiments have been omitted for the sake of brevity.

As shown in FIG. 15, the positions where the exhaust tubes 61*d* and 61*b* (which are closer to the air-fuel ratio sensor 65 and whose exhaust gas streams strike more strongly against the air-fuel ratio sensor 65) merge with the collector case 63 are upstream with respect to the positions where the exhaust tubes 61*a* and 61*c* (which are farther from the air-fuel ratio sensor 65) merge with the collector case 63. As a result, the expansion of the exhaust gas streams from the exhaust tubes 61*d* and 61*b* inside the collector case 63 begins sooner and excessive striking of the exhaust gas against the air-fuel ratio sensor 65 can be prevented.

In this embodiment of the present invention, each exhaust tube 61*a*–61*d* has a linear portion 64 directly and separately connected with the collector case 63. Consequently, the exhaust gas streams of each cylinder does not interfere with the exhaust gas streams of the other cylinders until it enters the collector case 63. Also, since the exhaust gas streams of each cylinder flows directly into the collector case 63, the amount of back-flow into the exhaust tubes of the other cylinders caused by exhaust pulsation is small. As a result, exhaust gas interference can be reduced and output can be improved.

Also in this embodiment of the present invention, the linear portions 64 of the exhaust tubes 61*a* to 61*d* with center axis collector case 63 is different for each exhaust tube 61*a* to 61*d*. Consequently, the connections of the exhaust tubes 61*a* to 61*d* with the collector case 63 can be laid out with a higher degree of freedom. Moreover, the linear portions 64 of the exhaust tubes 61*a* to 61*d* with center axis collector case are such that the merging positions of the exhaust tubes 61*b* and 61*d* that are closer to the air-fuel ratio sensor 65 are farther upstream. Thus, the exhaust gas streams from exhaust tubes 61*b* and 61*d* that are close to the air-fuel ratio sensor 65 spread inside the collector case 63 by the time they reach the air-fuel ratio sensor 65. Therefore, exhaust gas can be prevented from striking the air-fuel ratio sensor 65 too strongly and thermal degradation of the air-fuel ratio sensor 65 can be prevented. As a result, the air-fuel ratio can be controlled more precisely and emissions can be reduced because degradation of the air-fuel ratio sensor 65 over time can be reduced.

Seventh Embodiment

Figure 16:
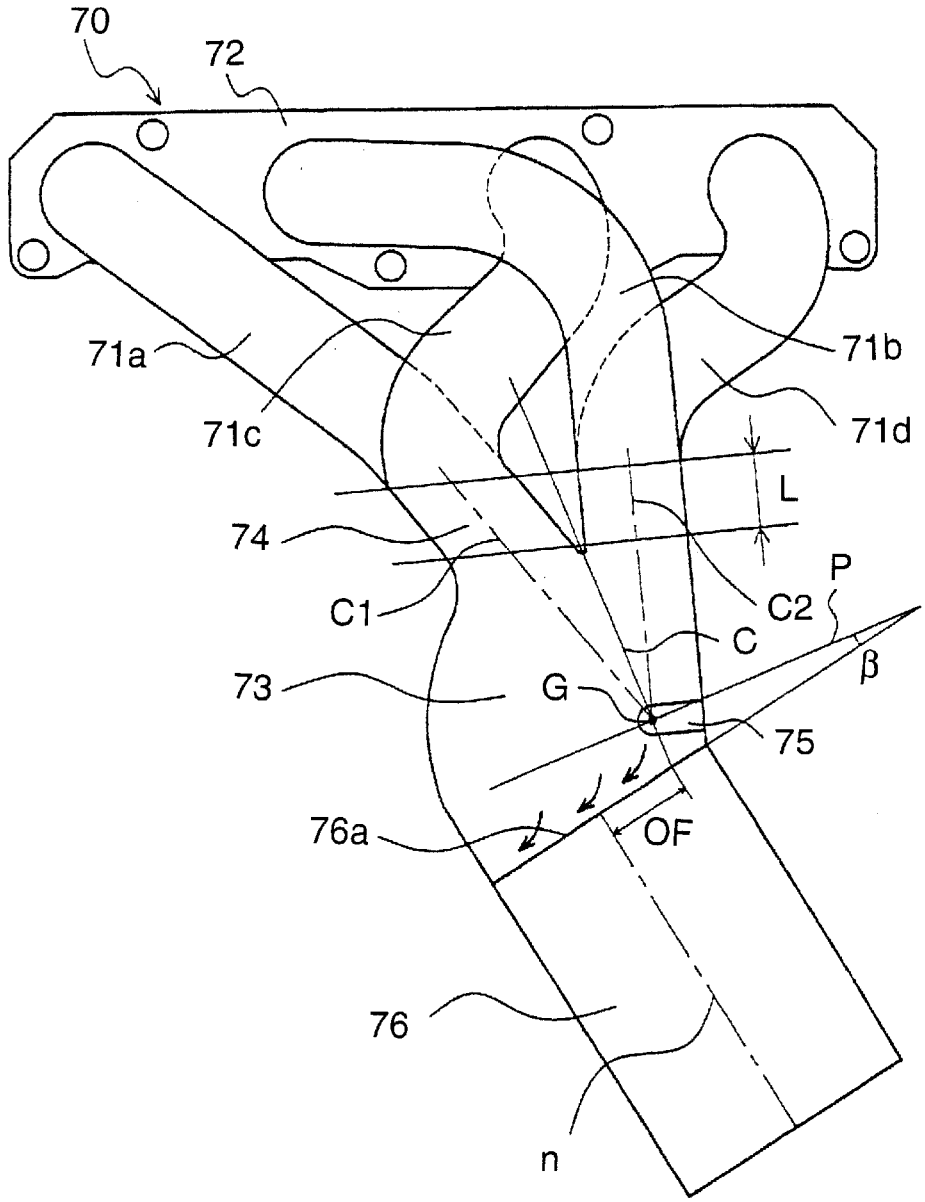
FIG. 16 is a simplified side elevational view of a modified exhaust manifold in accordance with a seventh embodiment of the present invention.

Referring now to FIG. 16, an internal combustion engine exhaust manifold 70 is illustrated in accordance with a seventh embodiment of the present invention. Basically, the fourth (FIG. 13) and seventh embodiments are identical, except that the outlet or downstream end of the collector case 73 has been changed as explained below. In view of the similarity between the seventh embodiment and the prior embodiments, the parts of the seventh embodiment that are identical to the parts of the prior embodiments will be given the same reference numerals increased by seventy as the parts of the first embodiment. Moreover, the descriptions of the parts of the seventh embodiment that are identical to the parts of the prior embodiments have been omitted for the sake of brevity.

The seventh embodiment differs from the fourth embodiment (FIG. 13) in that the front or upstream end 76*a* of the catalytic converter 76 is provided with tilt angle β when the catalytic converter 76 is mounted to the outlet of the collector case 73.

In the present invention, an axial line or centerline C constituting the center of the center axes of the linear portions 74 of the exhaust tubes 71*a* to 71*d* is offset from the center axis n of the catalyst converter 76 and the front end face 76*a* of the catalyst converter 76 is angled such that the distance from the merging portion where the exhaust tubes 71*a* to 71*d* merge with the collector case 73 to the front end face 76*a* of the catalyst converter 76 becomes longer. Therefore, the catalyst converter 76 can be utilized effectively and emissions can be reduced because the exhaust gas flows more uniformly through the inside of the catalyst converter 76.

More specifically, the center axis n of the catalytic converter 76 is positioned so as to be offset by an offset distance OF from the centerline C that represents an axial line of the center axes C1 and C2 of the linear portions 74 of the exhaust tubes 71*a* to 71*d*. In the illustrated embodiment, the centerline C bisects the angles between the center axes C1 and C2 of the linear portions 74 of the exhaust tubes 71*a* to 71*d*. Using perpendicular plane P, which is perpendicular to the centerline C, as a reference, the catalytic converter 76 is arranged so that the front end face 76*a* has a slant angle β. With this arrangement, the exhaust gas streams can form a flow that moves away from intersection point G of the exhaust tubes of the linear portions 74 at the front end face 76*a* of the catalytic converter 76. As a result, the flow of exhaust gas inside the catalytic converter 76 can be made more uniform.

Eighth Embodiment

Figure 17:
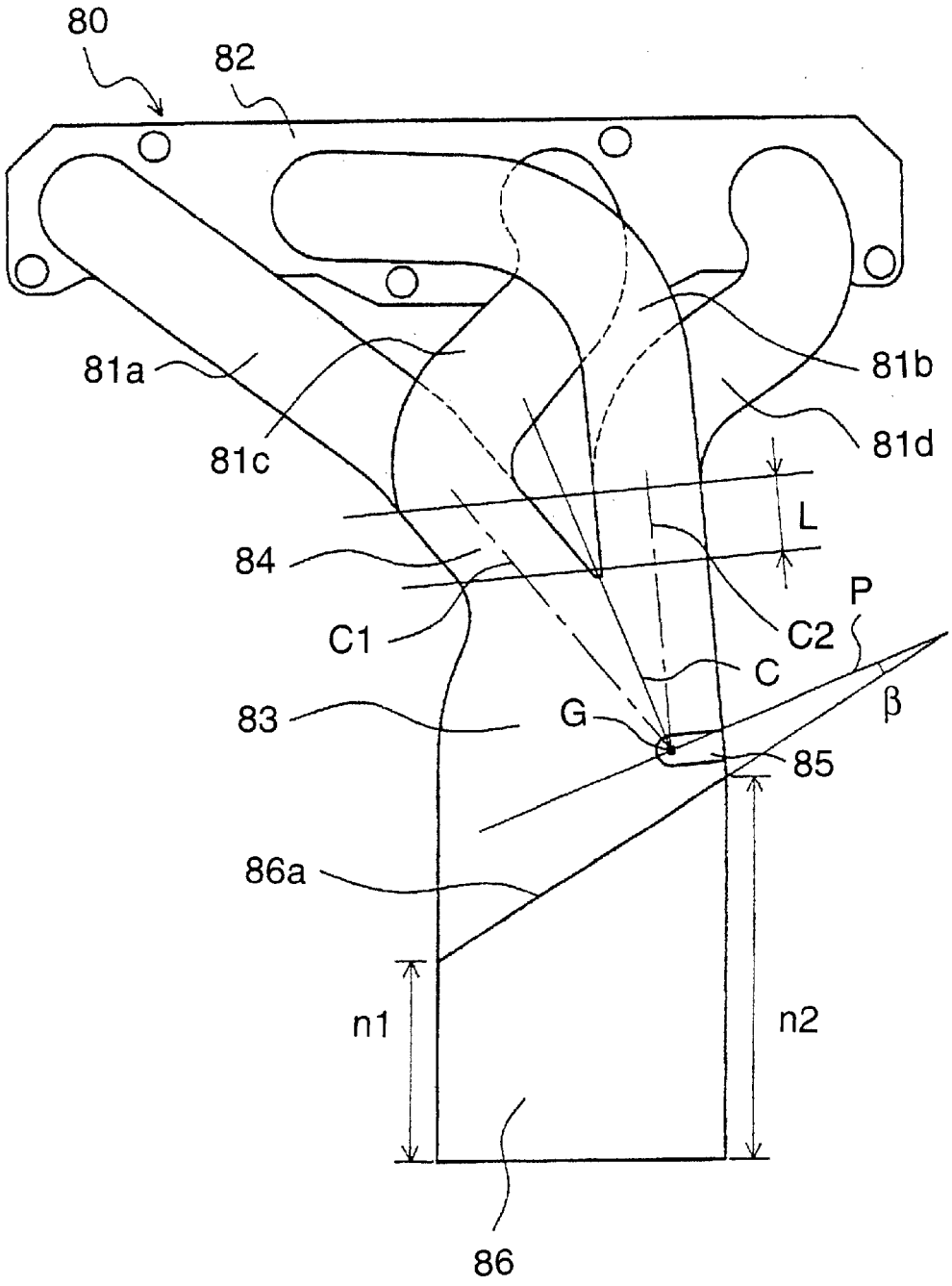
FIG. 17 is a simplified side elevational view of a modified exhaust manifold in accordance with an eighth embodiment of the present invention.

Referring now to FIG. 17, an internal combustion engine exhaust manifold 80 is illustrated in accordance with an eighth embodiment of the present invention. Basically, the seventh and eighth embodiments are identical, except that the connection between the catalytic converter 86 and the outlet or downstream end of the collector case 83 has been changed as explained below. In view of the similarity between the seventh and eighth embodiments, the parts of the eighth embodiment that are identical to the parts of the first embodiment will be given the same reference numerals increased by eighty as the parts of the first embodiment. Moreover, the descriptions of the parts of the eighth embodiment that are identical to the parts of the prior embodiments have been omitted for the sake of brevity.

FIG. 17 shows an example in which the catalytic converter 86 has a different length on its oxygen sensor side than on its opposite side. The catalyst length n2 on the side adjacent the oxygen sensor 85 in the vicinity of the intersection point G of the exhaust tube linear portions 84 is longer than the catalyst length n1 on the opposite side (n2>n1). The same effect can be obtained with this arrangement as with the arrangement in FIG. 16.

In this embodiment of the present invention, the front end face 86*a* of the catalytic converter 86 is angled with respect to a plane that is perpendicular to an axial line constituting the center C of the center axes C1 and C2 of the linear portions 84 of the exhaust tubes. Consequently, when the load is high and the flow rate of the exhaust gas is high, the flow of the exhaust gas concentrates on a portion of the catalytic converter 86 and thermal degradation of the catalyst can be prevented. As a result, reduction of the emission conversion rate of the catalyst can be prevented because degradation of the catalytic converter 86 over time can be prevented.

Ninth Embodiment

Figure 18:
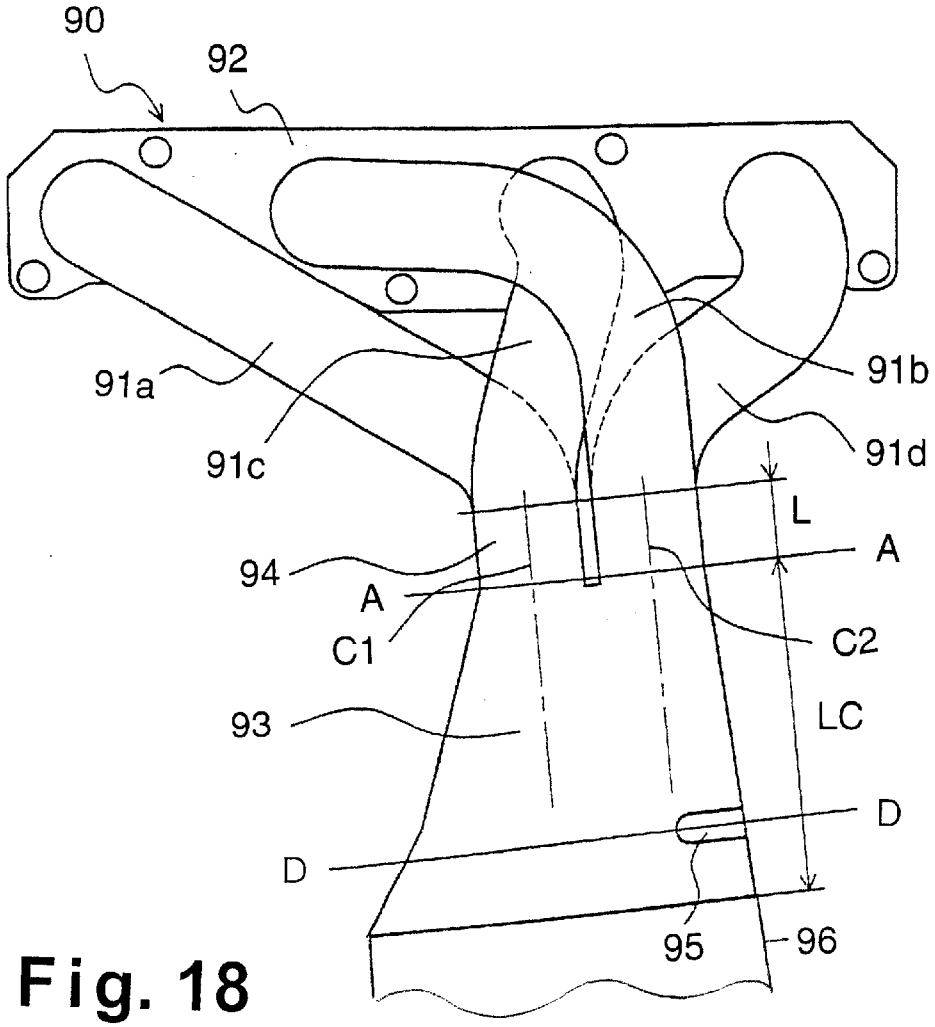
FIG. 18 is a simplified side elevational view of a modified exhaust manifold in accordance with a ninth embodiment of the present invention.
Figure 19:
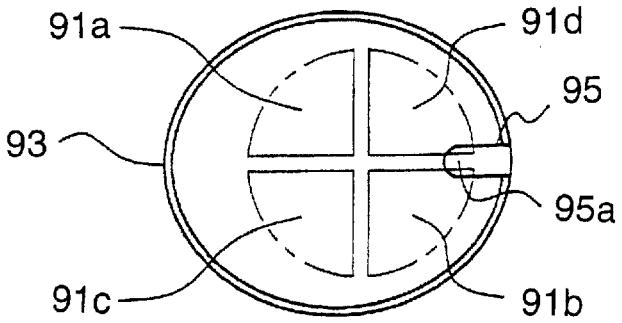
FIG. 19 is a cross sectional view of the exhaust manifold illustrated in FIG. 18 as viewed along line D—D of FIG. 18.

Referring now to FIGS. 18 and 19, an internal combustion engine exhaust manifold 90 is illustrated in accordance with a ninth embodiment of the present invention. Basically, the first and ninth embodiments are identical, except that angles of the exhaust tube 91*a* to 91*d* have been changed as explained below. In view of the similarity between the first and ninth embodiments, the parts of ninth embodiment that are identical to the parts of the first embodiment will be given the same reference numerals increased by ninety as the parts of the first embodiment. Moreover, the descriptions of the parts of the ninth embodiment that are identical to the parts of the first embodiment have been omitted for the sake of brevity.

The ninth embodiment differs from the first embodiment (FIG. 1) and the fourth embodiment (FIG. 13) in that the linear portions 94 of the exhaust tubes 91*a* to 91*d* of all cylinders are substantially parallel to one another just prior to the points that they are connected to the collector case 93.

Here, the length LC of the collector case 93 as measured from the portion where the exhaust tubes 91*a* to 91*d* join the collector case 93 to the catalyst 96 is sufficiently long in comparison with the lengths L of the linear portions 4 up to the portions where the exhaust tubes 91*a* to 91*d* merge with the collector case 93. This arrangement assumes that the collector case 93 is longer than situations where the linear portions 94 are angled to form intersection points within the collector case 93 or down stream thereof, as in the embodiments described previously.

Therefore, the linear portions 94 of the exhaust tubes 91*a* to 91*d* cause the flow of the exhaust gas streams to be directed in the direction of the linear portions 94. Since the linear portions 94 of all cylinders are substantially parallel, it is even more difficult (in comparison with a case where the linear portions are angled) for the exhaust gas streams to flow backward into one of the exhaust tubes of one of the other cylinders. As a result, exhaust interference is reduced further and output can be improved.

As shown in FIG. 19, the cross section of the collector case 93, as viewed upwardly along section line B—B of FIG. 18, is larger than the area circumscribing the linear portions 94 of the exhaust tubes 91*a* to 91*d*. Also as shown in FIG. 19, the air-fuel ratio sensor 95 is arranged such that its detecting part 95*a* is positioned within the projected cross sectional shape of the area circumscribing the substantially parallel linear portions 94 of the exhaust tubes 91*a* to 91*d*.

Also, in consideration of the flow direction of the exhaust gas, the air-fuel ratio sensor 95 should be arranged at a position some distance away from the merging portion of the exhaust tubes 91*a* to 91*d*. Thus, even if the air-fuel ratio sensor 95 is disposed on the side with the exhaust tubes 91*d* and 91*b*, the exhaust gas on the side with the exhaust tube 91*a* and 91*c* will diffuse and pass through the air-fuel ratio sensor 95 and the concentration of the exhaust gas of each cylinder can be detected more precisely.

However, with such an arrangement, there is the possibility that the temperature rise characteristic of the catalyst will worsen because the distance from the exhaust ports of the internal combustion engine to the catalyst installed at the outlet side of the collector case 93 is longer. Consequently, it is necessary to install the air-fuel ratio sensor 95 in a position where balance is achieved between the cylinder sensitivity of the sensor and the temperature rise characteristic of the catalyst.

Although the air-fuel ratio sensor 95 is illustrated in FIG. 19 as being installed between the exhaust tubes 91*d* and 91*b*, the air-fuel ratio sensor 95 can be installed anywhere within the circle of the projection plane. In this arrangement, the detecting part of the air-fuel ratio sensor 95 is positioned within projected cross sectional shape of the area circumscribing the substantially parallel linear portions 94 of the exhaust tubes 91*a* to 91*d* so that the air-fuel ratio sensor 95 can detect the concentration of the exhaust gas streams of each cylinder uniformly. As a result, the catalyst unit 96 can be utilized effectively and emissions can be reduced because the air-fuel ratio can be controlled with good precision.

Additionally, since the linear portions 94 of the exhaust tubes 91*a* to 91*d* for all cylinders are substantially parallel, exhaust interference within the collector case 93 is reduced even further and further improvement of the output performance can be expected. This arrangement is inferior to that of the first embodiment in that the exhaust gas streams from the cylinders are only mixed to a small degree inside the collector case 93. However, mixing of the exhaust gas streams is not a problem if the length of the collector case 93 (i.e., the distance from the merging position of the exhaust tubes to the catalytic converter 96) is made long enough to allow through mixing.

Tenth Embodiment

Figure 20:
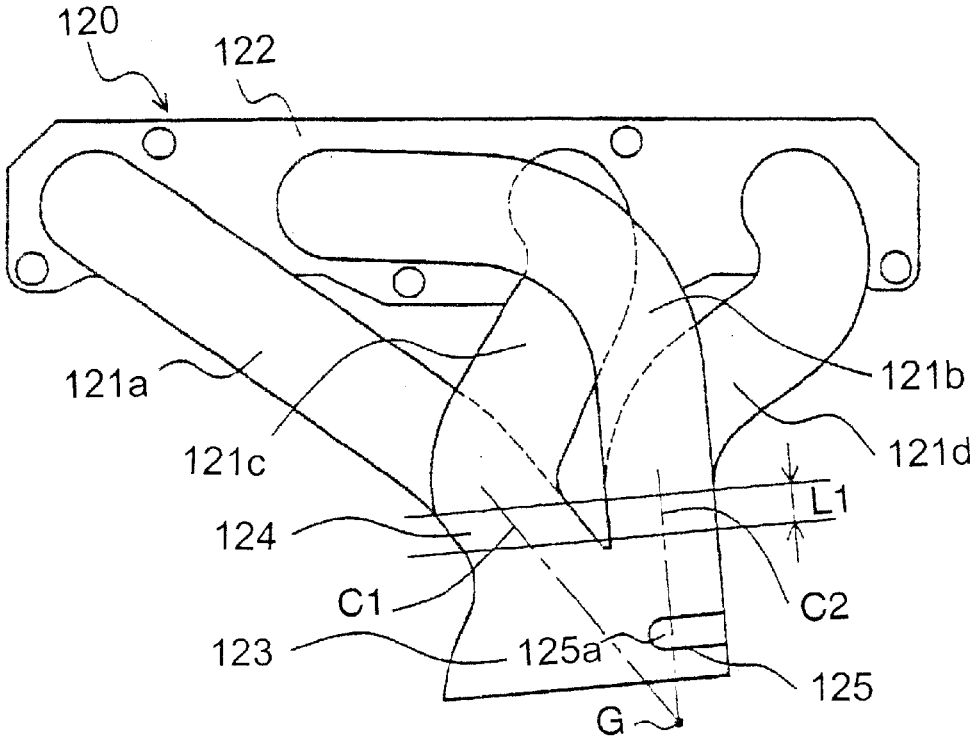
FIG. 20 is a simplified side elevational view of a modified exhaust manifold in accordance with a tenth embodiment of the present invention in which the intersection point is downstream of the collector case.

Referring now to FIG. 20, an internal combustion engine exhaust manifold 120 is illustrated in accordance with a tenth embodiment of the present invention. Basically, the first and tenth embodiments are identical, except that the intersection point G relative to the collector case 123 has been modified in this tenth embodiment as explained below. In view of the similarity between the first and tenth embodiments, the parts of the tenth embodiment that are identical to the parts of the first embodiment will be given the same reference numerals as the parts of the first embodiment, but increased by one hundred and twenty. Moreover, the descriptions of the parts of the tenth embodiment that are identical to the parts of the first embodiment may be omitted for the sake of brevity.

In the first embodiment, the center axes C1 and C2 of the linear portions 4 intersect at the intersection point G inside the collector case 3. In this tenth embodiment, the intersection point G of the center axes C1 and C2 of the linear portions 124 intersect at a location downstream of the collector case 123, as shown in FIG. 20, since the length of collector case 123 is shorter than in the first embodiment. In this tenth embodiment, the concentration of the exhaust gas of each cylinder can be detected uniformly by positioning the detecting part 125*a* of the air-fuel ratio sensor 125 in the close to intersection point G of the center axes C1 and C2 of the linear portions 124.

Here, exhaust interference is reduced because the linear portions 124 of the exhaust tube 121*a* of cylinder #1 and the exhaust tube 121*c* of cylinder #3, which cylinders have successive firing orders, are substantially parallel to each other. Likewise, the linear portions 124 of the exhaust tube 121*d* of cylinder #4 and the exhaust tube 121*b* of cylinder #2 are substantially parallel.

Eleventh Embodiment

Figure 21:
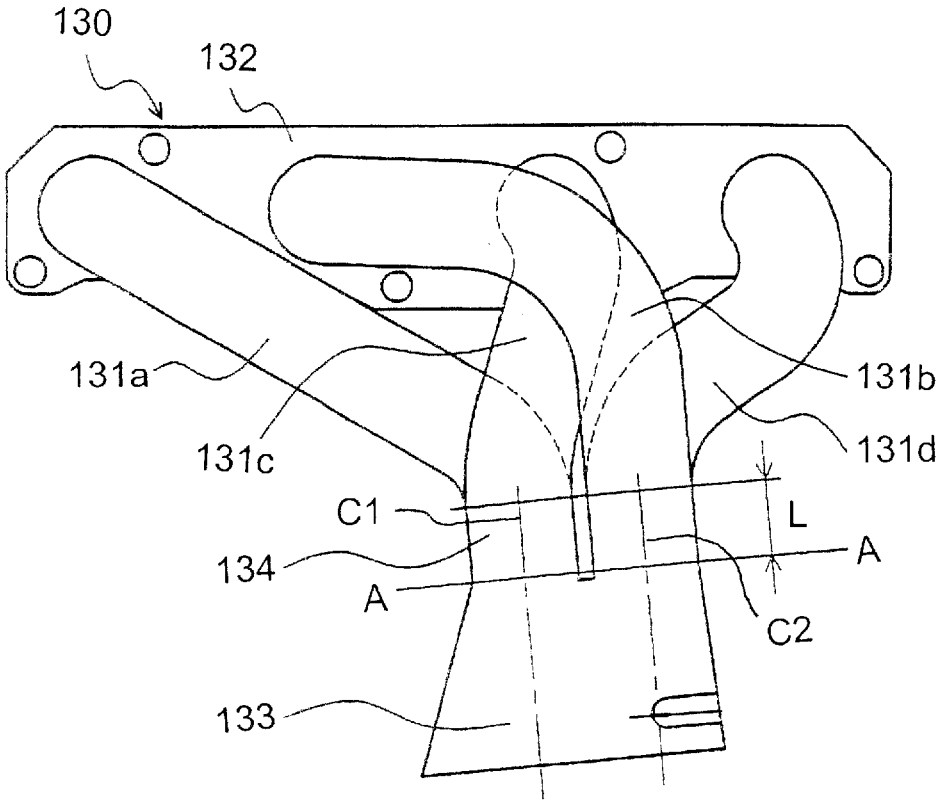
FIG. 21 is a simplified side elevational view of an exhaust manifold in accordance with an eleventh embodiment of the present invention in which the exhaust tubes of the cylinders are all angled.
Figure 22:
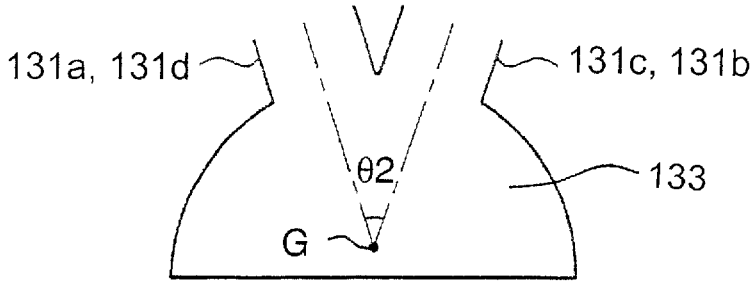
FIG. 22 is a simplified lateral cross sectional view of the exhaust manifold in accordance with a third embodiment of the present invention in which the exhaust tubes of the cylinders are all angled.

Referring now to FIGS. 21 and 22, an internal combustion engine exhaust manifold 130 is illustrated in accordance with an eleventh embodiment of the present invention. Basically, the first and eleventh embodiments are identical, except that the intersection point G relative to the collector case 133 has been modified in this eleventh embodiment as explained below. In view of the similarity between the first and eleventh embodiments, the parts of the eleventh embodiment that are identical to the parts of the first embodiment will be given the same reference numerals as the parts of the first embodiment, but increased by one hundred and thirty. Moreover, the descriptions of the parts of the eleventh embodiment that are identical to the parts of the first embodiment may be omitted for the sake of brevity.

FIG. 21 shows the basic features of the eleventh embodiment of the internal combustion engine exhaust manifold 130 in accordance with the present invention while FIG. 22 shows a schematic lateral cross sectional view of the internal combustion engine exhaust manifold 130 as viewed from the left. The eleventh embodiment is structured such that, when viewed from the side (FIG. 21), the exhaust tubes of pairs of cylinders whose firing orders are not successive (i.e., the pair of cylinders #1 and #4 coupled to the exhaust tubes 131*a* and 131*d* and the pair cylinders #2 and #34 coupled to the exhaust tubes 131*b* and 131*c*) are parallel. When viewed from the side (FIG. 22), the exhaust tubes of pairs of cylinders whose firing orders are successive (i.e., the pair cylinders #1 and #3 coupled to the exhaust tubes 131*a* and 131*c* and the pair cylinders #2 and #4 coupled to the exhaust tubes 131*b* and 131*d*) are slanted to form a pair of intersection points G. This embodiment functions in the same manner as the first embodiment (FIG. 1) and the fourth embodiment (FIG. 1), except that the arrangement of the exhaust tubes 131*a* to 131*d* is different.

Figure 23:
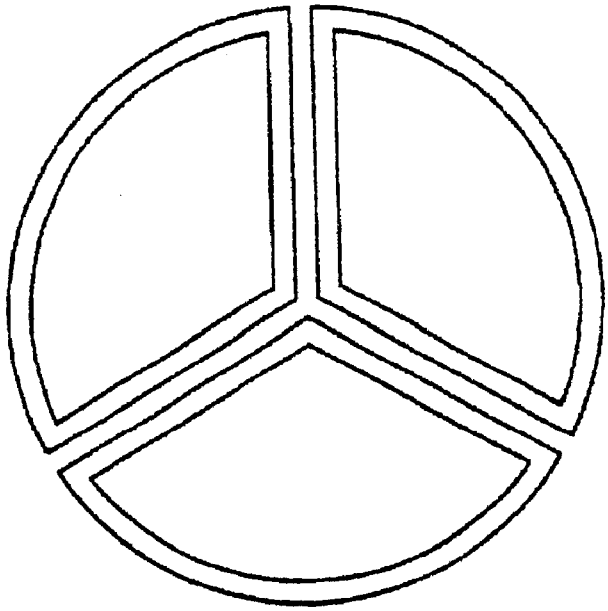
FIG. 23 is a cross sectional view, similar to FIG. 2, of a modified exhaust manifold that can be used in any of the preceding embodiments of the present invention when only three cylinders are merged together.

Although the above examples illustrate engine exhaust manifolds for four cylinders, it will be apparent to those skilled in the art from this disclosure that each of the engine exhaust manifolds, discussed above, can be used with three cylinders. In examples with three cylinders (including examples with groups of three cylinders, such as a V-6 engine), the linear part of the exhaust tubes of all cylinders can be arranged such that their center axes intersect and form an intersection point. FIG. 23 shows the cross sectional shape at the portion where the exhaust tube of each cylinder merges with the collector case in a situation where there are three cylinders (including V-6 engines). When there are three cylinders, the cross section of the exhaust tubes comprises fan shapes with 120-degree center angles therebetween. The present invention can also be applied to other numbers of cylinders by changing the center angle between the fan shapes. Based on this same principle, the present invention can also be applied to a six-cylinder inline engine.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application Nos. 2000-373501 and 2001-347990. The entire disclosures of Japanese Patent Application Nos. 2000-373501 and 2001-347990 are hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An exhaust manifold of an internal combustion engine having a first, second, third and fourth cylinders, the exhaust manifold comprising:

a collector case having an upstream end and a downstream end, the downstream end being attached to a catalyst unit;

a first exhaust tube having a first inlet end, a first outlet end and a first linear portion, the first exhaust tube being configured and arranged to receive an exhaust gas only from the first cylinder, the first inlet end being configured and arranged to be connected to an exhaust port of the first cylinder of the internal combustion engine, the first outlet end being connected to the upstream end of the collector case, the first linear portion being located directly above the first outlet end;

a second exhaust tube having a second inlet end, a second outlet end and a second linear portion, the second exhaust tube being configured and arranged to receive an exhaust gas only from the second cylinder, the second inlet end being configured and arranged to be connected to an exhaust port of the second cylinder of the internal combustion engine, the second outlet end being connected to the upstream end of the collector case, the second linear portion being located directly above the second outlet end;

a third exhaust tube having a third inlet end, a third outlet end and a third linear portion, the third exhaust tube being configured and arranged to receive an exhaust gas only from the third cylinder, the third inlet end being configured and arranged to be connected to an exhaust port of the third cylinder of the internal combustion engine, the third outlet end being connected to the upstream end of the collector case, the third linear portion being located directly above the third outlet end, a center axis of the third linear portion of the third exhaust tube being substantially parallel with a center axis of the first linear portion of the first exhaust tube and intersecting a center axis of the second linear portion of the second exhaust tube at a first intersection point inside the collector case or downstream thereof; and a fourth exhaust tube having a fourth inlet end, a fourth outlet end and a fourth linear portion, the fourth exhaust tube being configured and arranged to receive an exhaust gas only from the fourth cylinder, the fourth inlet end being configured and arranged to be connected to an exhaust port of the fourth cylinder of the internal combustion engine, the fourth outlet end being connected to the upstream end of the collector case, the fourth linear portion being located directly above the fourth outlet end, a center axis of the fourth linear portion of the fourth exhaust tube being substantially parallel with the center axis of the second linear portion of the second exhaust tube and intersecting the center axis of the first linear portion of the first exhaust tube at a second intersection point inside the collector case or downstream thereof.

2. The exhaust manifold as recited in claim 1, wherein the first, second, third and fourth inlet ends of the first, second, third and fourth exhaust tubes, respectively, are arranged relative to each other such that firing orders of the first cylinder and the third cylinder are successive and firing orders of the second cylinder and the fourth cylinder are successive.

3. The exhaust manifold as recited in claim 2, wherein the first, second, third and fourth inlet ends of the first, second, third and fourth exhaust tubes, respectively, are arranged relative to each other such that firing orders of the first cylinder and the fourth cylinders are not successive and firing orders of the third cylinder and the second cylinder are not successive.

4. The exhaust manifold as recited in claim 1, wherein the collector case has an air-fuel ratio sensor installed inside the collector case with a detecting part of the air-fuel ratio sensor being positioned adjacent the first and second intersection points.

5. The exhaust manifold as recited in claim 4, wherein the detecting part of the air-fuel ratio sensor has a center axis; and the center axes of the first and fourth linear portions of the first and fourth exhaust tubes, respectively, and the center axis of the air fuel ratio sensor form angles therebetween with an angle of one of the first and fourth linear portions that is farther from the air-fuel ratio sensor being closer to perpendicular than an angle of the other of the first and fourth linear portions that is closer to the air-fuel ratio sensor.

6. The exhaust manifold as recited in claim 1, wherein the collector case has an air fuel ratio sensor located in the collector case, and at least some of the first, second, third and fourth outlet ends open into the collector case at different distances from the air fuel ratio sensor as measured in an air stream direction of each of the first, second, third and fourth exhaust tubes into the collector case.

7. The exhaust manifold as recited in claims 6, wherein at least one of the first, second, third and fourth outlet ends of the first, second, third and fourth exhaust tubes, respectively, that is closer to the air-fuel ratio sensor, as measured in a transverse direction to the air stream directions, is spaced farther upstream from the air-fuel ratio sensor as measured in a longitudinal direction of the air stream directions.

8. The exhaust manifold as recited in claim 1, wherein the catalyst unit includes a front end face connected to the downstream end of the collector case, the front end face being angled with respect to a reference plane which is perpendicular to an axial line that represents a center line of the center axes of the first, second, third and fourth linear portions of the first, second, third and fourth exhaust tubes, respectively.

9. The exhaust manifold as recited in claim 8, wherein the catalyst unit has a center axis that is offset from the centerline of the center axes of the first, second, third and fourth linear portions of the first, second, third and fourth exhaust tubes, respectively; and the front end face of the catalyst unit is angled such that distances of the upstream end of the collector case to the front end face of the catalyst unit becomes longer across the front end face of the catalyst unit.

10. The exhaust manifold as recited in claim 1, wherein the first, second, third and fourth linear portions of the first, second, third and fourth exhaust tubes, respectively, have substantially fan-shaped cross sectional shapes that are substantially equal in size where the first, second, third and fourth exhaust tubes are connected to the collector case.

11. An exhaust manifold of an internal combustion engine having a first, second, third and fourth cylinders, the exhaust manifold comprising:

a collector case having an upstream end and a downstream end, the downstream end being attached to a catalyst unit;

a first exhaust tube having a first inlet end, a first outlet end and a first linear portion, the first inlet end being configured and arranged to be connected to an exhaust port of the first cylinder of the internal combustion engine, the first outlet end being connected to the upstream end of the collector case, the first linear portion being located directly above the first outlet end;

a second exhaust tube having a second inlet end, a second outlet end and a second linear portion, the second inlet end being configured and arranged to be connected to an exhaust port of the second cylinder of the internal combustion engine, the second outlet end being connected to the upstream end of the collector case, the second linear portion being located directly above the second outlet end;

a third exhaust tube having a third inlet end, a third outlet end and a third linear portion, the third inlet end being configured and arranged to be connected to an exhaust port of the third cylinder of the internal combustion engine, the third outlet end being connected to the upstream end of the collector case, the third linear portion being located directly above the third outlet end, a center axis of the third linear portion of the third exhaust tube being substantially parallel with a center axis of the first linear portion of the first exhaust tube and intersecting a center axis of the second linear portion of the second exhaust tube at a first intersection point inside the collector case or downstream thereof; and a fourth exhaust tube having a fourth inlet end, a fourth outlet end and a fourth linear portion, the fourth inlet end being configured and arranged to be connected to an exhaust port of the fourth cylinder of the internal combustion engine, the fourth outlet end being connected to the upstream end of the collector case, the fourth linear portion being located directly above the fourth outlet end, a center axis of the fourth linear portion of the fourth exhaust tube being substantially parallel with the center axis of the second linear portion of the second exhaust tube and intersecting the center axis of the first linear portion of the first exhaust tube at a second intersection point inside the collector case or downstream thereof, the first, second, third and fourth outlet ends and the collector case being configured and arranged to create a vortex of exhaust gases above the catalyst unit.

12. The exhaust manifold as recited in claim 11, wherein the first, second, third and fourth inlet ends of the first, second, third and fourth exhaust tubes, respectively, are arranged relative to each other such that firing orders of the first cylinder and the third cylinder are successive and firing orders of the second cylinder and the fourth cylinder are successive.

13. The exhaust manifold as recited in claim 12, wherein the first, second, third and fourth inlet ends of the first, second, third and fourth exhaust tubes, respectively, are arranged relative to each other such that firing orders of the first cylinder and the fourth cylinders are not successive and firing orders of the third cylinder and the second cylinder are not successive.

14. The exhaust manifold as recited in claim 11, wherein the collector case has an air-fuel ratio sensor installed inside the collector case with a detecting part of the air-fuel ratio sensor being positioned adjacent the first and second intersection points.

15. The exhaust manifold as recited in claim 14, wherein the detecting part of the air-fuel ratio sensor has a center axis; and the center axes of the first and fourth linear portions of the first and fourth exhaust tubes, respectively, and the center axis of the air fuel ratio sensor form angles therebetween with an angle of one of the first and fourth linear portions that is farther from the air-fuel ratio sensor being closer to perpendicular than an angle of the other of the first and fourth linear portions that is closer to the air-fuel ratio sensor.

16. An exhaust manifold of an internal combustion engine having a first, second, third and fourth cylinders, the exhaust manifold comprising:

a collector case having an upstream end and a downstream end, the downstream end being attached to a catalyst unit;

a first exhaust tube having a first inlet end, a first outlet end and a first linear portion, the first inlet end being arranged to be connected to an exhaust port of the first cylinder of the internal combustion engine, the first outlet end being connected to the upstream end of the collector case, the first linear portion being located directly above the first outlet end;

a second exhaust tube having a second inlet end, a second outlet end and a second linear portion, the second inlet end being arranged to be connected to an exhaust port of the second cylinder of the internal combustion engine, the second outlet end being connected to the upstream end of the collector case, the second linear portion being located directly above the second outlet end;

a third exhaust tube having a third inlet end, a third outlet end and a third linear portion, the third inlet end being arranged to be connected to an exhaust port of the third cylinder of the internal combustion engine, the third outlet end being connected to the upstream end of the collector case, the third linear portion being located directly above the third outlet end, a center axis of the third linear portion of the third exhaust tube being substantially parallel with a center axis of the first linear portion of the first exhaust tube and intersecting a center axis of the second linear portion of the second exhaust tube at a first intersection point inside the collector case or downstream thereof; and a fourth exhaust tube having a fourth inlet end, a fourth outlet end and a fourth linear portion, the fourth inlet end being arranged to be connected to an exhaust port of the fourth cylinder of the internal combustion engine, the fourth outlet end being connected to the upstream end of the collector case, the fourth linear portion being located directly above the fourth outlet end, a center axis of the fourth linear portion of the fourth exhaust tube being substantially parallel with the center axis of the second linear portion of the second exhaust tube and intersecting the center axis of the first linear portion of the first exhaust tube at a second intersection point inside the collector case or downstream thereof, the first, second, third and fourth outlet ends being configured and arranged relative to the upstream end of the collector case such that the first and second intersection points are located adjacent a side wall of the collector case.

17. The exhaust manifold as recited in claim 16, wherein the first, second, third and fourth inlet ends of the first, second, third and fourth exhaust tubes, respectively, are arranged relative to each other such that firing orders of the first cylinder and the third cylinder are successive and firing orders of the second cylinder and the fourth cylinder are successive.

18. The exhaust manifold as recited in claim 17, wherein the first, second, third and fourth inlet ends of the first, second, third and fourth exhaust tubes, respectively, are arranged relative to each other such that firing orders of the first cylinder and the fourth cylinders are not successive and firing orders of the third cylinder and the second cylinder are not successive.

19. An exhaust manifold of an internal combustion engine having a first, second, third and fourth cylinders, the exhaust manifold comprising:

a collector case having an upstream end and a downstream end, the downstream end being attached to a catalyst unit;

a first exhaust tube having a first inlet end, a first outlet end and a first linear portion, the first inlet end being arranged to be connected to an exhaust port of the first cylinder of the internal combustion engine, the first outlet end being connected to the upstream end of the collector case, the first linear portion being located directly above the first outlet end;

a second exhaust tube having a second inlet end, a second outlet end and a second linear portion, the second inlet end being arranged to be connected to an exhaust port of the second cylinder of the internal combustion engine, the second outlet end being connected to the upstream end of the collector case, the second linear portion being located directly above the second outlet end;

a third exhaust tube having a third inlet end, a third outlet end and a third linear portion, the third inlet end being arranged to be connected to an exhaust port of the third cylinder of the internal combustion engine, the third outlet end being connected to the upstream end of the collector case, the third linear portion being located directly above the third outlet end, a center axis of the third linear portion of the third exhaust tube being substantially parallel with a center axis of the first linear portion of the first exhaust tube and intersecting a center axis of the second linear portion of the second exhaust tube at a first intersection point inside the collector case or downstream thereof; and a fourth exhaust tube having a fourth inlet end, a fourth outlet end and a fourth linear portion, the fourth inlet end being arranged to be connected to an exhaust port of the fourth cylinder of the internal combustion engine, the fourth outlet end being connected to the upstream end of the collector case, the fourth linear portion being located directly above the fourth outlet end, a center axis of the fourth linear portion of the fourth exhaust tube being substantially parallel with the center axis of the second linear portion of the second exhaust tube and intersecting the center axis of the first linear portion of the first exhaust tube at a second intersection point inside the collector case or downstream thereof, the collector case having an air-fuel ratio sensor installed inside the collector case with a detecting part of the air-fuel ratio sensor being positioned adjacent a midpoint of the first and second intersection points.

20. The exhaust manifold as recited in claim 19, wherein the first, second, third and fourth inlet ends of the first, second, third and fourth exhaust tubes, respectively, are arranged relative to each other such that firing orders of the first cylinder and the third cylinder are successive and firing orders of the second cylinder and the fourth cylinder are successive.

21. The exhaust manifold as recited in claim 20, wherein the first, second, third and fourth inlet ends of the first, second, third and fourth exhaust tubes, respectively, are arranged relative to each other such that firing orders of the first cylinder and the fourth cylinders are not successive and firing orders of the third cylinder and the second cylinder are not successive.

22. An exhaust manifold of an internal combustion engine having a first, second, third and fourth exhaust ports connected to a first, second, third and fourth cylinders, respectively, the exhaust manifold comprising:

a collector case having a substantially partial spherical upstream end and a downstream end, the downstream end being attached to a catalyst unit;

a first exhaust tube having a first inlet end, a first outlet end and a first linear portion, the first inlet end being configured and arranged to be connected to an exhaust port of the first cylinder of the internal combustion engine, the first outlet end being connected to the substantially partial spherical upstream end of the collector case to avoid disruption of exhaust flow in the collector case, the first linear portion being located directly above the first outlet end;

a second exhaust tube having a second inlet end, a second outlet end and a second linear portion, the second inlet end being configured and arranged to be connected to an exhaust port of the second cylinder of the internal combustion engine, the second outlet end being connected to the substantially partial spherical upstream end of the collector case to avoid disruption of exhaust flow in the collector case, the second linear portion being located directly above the second outlet end;

a third exhaust tube having a third inlet end, a third outlet end and a third linear portion, the third inlet end being configured and arranged to be connected to an exhaust port of the third cylinder of the internal combustion engine, the third outlet end being connected to the substantially partial spherical upstream end of the collector case to avoid disruption of exhaust flow in the collector case, the third linear portion being located directly above the third outlet end, a center axis of the third linear portion of the third exhaust tube being substantially parallel with a center axis of the first linear portion of the first exhaust tube and intersecting a center axis of the second linear portion of the second exhaust tube at a first intersection point inside the collector case or downstream thereof; and a fourth exhaust tube having a fourth inlet end, a fourth outlet end and a fourth linear portion, the fourth inlet end being configured and arranged to be connected to an exhaust port of the fourth cylinder of the internal combustion engine, the fourth outlet end being connected to the substantially partial spherical upstream end of the collector case to avoid disruption of exhaust flow in the collector case, the fourth linear portion being located directly above the fourth outlet end, a center axis of the fourth linear portion of the fourth exhaust tube being substantially parallel with the center axis of the second linear portion of the second exhaust tube and intersecting the center axis of the first linear portion of the first exhaust tube at a second intersection point inside the collector case or downstream thereof.

23. The exhaust manifold as recited in claim 22, wherein the first, second, third and fourth inlet ends of the first, second, third and fourth exhaust tubes, respectively, are arranged relative to each other such that firing orders of the first cylinder and the third cylinder are successive and firing orders of the second cylinder and the fourth cylinder are successive.

24. The exhaust manifold as recited in claim 23, wherein the first, second, third and fourth inlet ends of the first, second, third and fourth exhaust tubes, respectively, are arranged relative to each other such that firing orders of the first cylinder and the fourth cylinders are not successive and firing orders of the third cylinder and the second cylinder are not successive.

25. An exhaust manifold of an internal combustion engine having a plurality of cylinders, the exhaust manifold comprising:

a collector case having an upstream end and a downstream end, the downstream end being attached to a catalyst unit;

a first exhaust tube having a first inlet end, a first outlet end and a first linear portion, the first inlet end being configured and arranged to be connected to an exhaust port of one of the cylinders, the first outlet end being connected to the upstream end of the collector case, the first linear portion being located directly above the first outlet end;

a second exhaust tube having a second inlet end, a second outlet end and a second linear portion, the second inlet end being configured and arranged to be connected to an exhaust port of one of the cylinders, the second outlet end being connected to the upstream end of the collector case, the second linear portion being located directly above the second outlet end, a center axis of the second linear portion of the second exhaust tube intersecting a center axis of the first linear portion of the first exhaust tube at an intersection point inside the collector case or downstream thereof; and a third exhaust tube having a third inlet end, a third outlet end and a third linear portion, the third inlet end being configured and arranged to be connected to an exhaust port of one of the cylinders, the third outlet end being connected to the upstream end of the collector case, the third linear portion being located directly above the third outlet end, a center axis of the third linear portion of the third exhaust tube intersecting the center axis of the first linear portion of the first exhaust tube at the intersection point, the first, second and third outlet ends and the collector case being configured and arranged to create a vortex of exhaust gases above the catalyst unit, the collector case having an air fuel ratio sensor located in the collector case, and at least some of the first, second and third outlet ends opening into the collector case at different distances from the air fuel ratio sensor as measured in an air stream direction of each of the first, second and third exhaust tubes into the collector case.

26. The exhaust manifold as recited in claims 25, wherein at least one of the first, second and third outlet ends of the first, second and third exhaust tubes, respectively, that is closer to the air-fuel ratio sensor, as measured in a transverse direction to the air stream directions, is spaced farther upstream from the air-fuel ratio sensor as measured in a longitudinal direction of the air stream directions.

27. An exhaust manifold of an internal combustion engine having a plurality of cylinders, the exhaust manifold comprising:

a collector case having a substantially partial spherical upstream end and a downstream end, the downstream end being attached to a catalyst unit;

a first exhaust tube having a first inlet end, a first outlet end and a first linear portion, the first inlet end being configured and arranged to be connected to an exhaust port of one of the cylinders, the first outlet end being connected to the substantially partial spherical upstream end of the collector case to avoid disruption of exhaust flow in the collector case, the first linear portion being located directly above the first outlet end;

a second exhaust tube having a second inlet end, a second outlet end and a second linear portion, the second inlet end being configured and arranged to be connected to an exhaust port of one of the cylinders, the second outlet end being connected to the substantially partial spherical upstream end of the collector case to avoid disruption of exhaust flow in the collector case, the second linear portion being located directly above the second outlet end, a center axis of the second linear portion of the second exhaust tube intersecting a center axis of the first linear portion of the first exhaust tube at an intersection point inside the collector case or downstream thereof;

a third exhaust tube having a third inlet end, a third outlet end and a third linear portion, the third inlet end being configured and arranged to be connected to an exhaust port of one of the cylinders, the third outlet end being connected to the substantially partial spherical upstream end of the collector case to avoid disruption of exhaust flow in the collector case, the third linear portion being located directly above the third outlet end, a center axis of the third linear portion of the third exhaust tube intersecting the center axis of the first linear portion of the first exhaust tube at the intersection point.

28. The exhaust manifold as recited in claims 27, further comprising a fourth exhaust tube having a fourth inlet end, a fourth outlet end and a fourth linear portion, the fourth inlet end being configured and arranged to be connected to an exhaust port of one of the cylinders, the fourth outlet end being connected to the substantially partial spherical upstream end of the collector case to avoid disruption of exhaust flow in the collector case, the fourth linear portion being located directly above the fourth outlet end, a center axis of the fourth linear portion of the fourth exhaust tube intersecting the center axis of the first linear portion of the first exhaust tube at the intersection point.

29. The exhaust manifold as recited in claim 28, wherein, the collector case has an air-fuel ratio sensor installed inside the collector case with a detecting part of the air-fuel ratio sensor being positioned adjacent the intersection point.

* * * * *